US009399898B2

(12) United States Patent
Muntz et al.

(10) Patent No.: US 9,399,898 B2
(45) Date of Patent: Jul. 26, 2016

(54) CORE DRILLING TOOLS WITH RETRACTABLY LOCKABLE DRIVEN LATCH MECHANISMS

(71) Applicant: Longyear TM, Inc., South Jordan, UT (US)

(72) Inventors: Charles Ernest Muntz, Woodvale (AU); Christopher L. Drenth, Burlington (CA); George Iondov, Mississauga (CA)

(73) Assignee: Longyear TM, Inc., Salt Lake City, UT (US)

( * ) Notice: Subject to any disclaimer, the term of this patent is extended or adjusted under 35 U.S.C. 154(b) by 290 days.

(21) Appl. No.: 14/193,136

(22) Filed: Feb. 28, 2014

(65) Prior Publication Data

US 2014/0174828 A1 Jun. 26, 2014

Related U.S. Application Data

(63) Continuation-in-part of application No. 13/943,460, filed on Jul. 16, 2013, now Pat. No. 9,234,398, which is a continuation of application No. 12/968,127, filed on Dec. 14, 2010, now Pat. No. 8,485,280, which is a (Continued)

(51) Int. Cl.

| | |
|---|---|
| ***E21B 25/02*** | (2006.01) |
| ***E21B 10/02*** | (2006.01) |
| ***E21B 23/02*** | (2006.01) |

(52) U.S. Cl.

CPC ..... *E21B 25/02* (2013.01)

(58) Field of Classification Search

CPC ..... E21B 25/02; E21B 10/02; E21B 23/02
USPC ..... 175/246, 403
See application file for complete search history.

(56) References Cited

U.S. PATENT DOCUMENTS

| | | | |
|---|---|---|---|
| 1,643,730 | A | 9/1927 | Wild |
| 2,510,865 | A | 6/1950 | Cooper |
| 2,521,886 | A | 9/1950 | Walker |
| 2,829,868 | A | 4/1958 | Pickard |
| 3,092,191 | A | 6/1963 | Austin |

(Continued)

FOREIGN PATENT DOCUMENTS

| | | |
|---|---|---|
| AU | 2008222974 | 3/2008 |
| AU | 2008222974 A1 | 9/2008 |

(Continued)

OTHER PUBLICATIONS

U.S. Appl. No. 14/193,136, Muntz et al.

(Continued)

*Primary Examiner* — Kenneth L Thompson
(74) *Attorney, Agent, or Firm* — Ballard Spahr LLP

(57) ABSTRACT

Drilling systems and methods for deploying a latch mechanism upon reaching a drilling position. The drilling systems and methods permit spinning of a drill string to cause a core barrel head assembly to spin through the frictional mating of a landing shoulder of the head assembly and a landing ring of an outer tube assembly. The spinning of the drill string induces a centrifugal and/or radial force that acts on the latch mechanism to overcome the frictional retention forces acting on the latch mechanism, thereby permitting deployment of the latch mechanism.

22 Claims, 17 Drawing Sheets

Related U.S. Application Data continuation-in-part of application No. 12/898,878, filed on Oct. 6, 2010, now Pat. No. 8,794,355, application No. 14/193,136, which is a continuation-in-part of application No. 13/593,338, filed on Aug. 23, 2012, now Pat. No. 8,770,322.

(60) Provisional application No. 61/287,106, filed on Dec. 16, 2009, provisional application No. 61/249,544, filed on Oct. 7, 2009.

(56) References Cited

U.S. PATENT DOCUMENTS

| | | | | |
|---|---|---|---|---|
| 3,103,981 | A | 9/1963 | Harper | |
| 3,115,188 | A | 12/1963 | Cochran | |
| 3,126,064 | A | 3/1964 | Miller | |
| 3,225,845 | A | 12/1965 | Koontz | |
| 3,333,647 | A | 8/1967 | Karich | |
| 3,004,614 | A | 10/1967 | De Witt | |
| 3,346,059 | A | 10/1967 | Svendsen | |
| 3,363,705 | A | 1/1968 | Jensen | |
| 3,461,981 | A | 8/1969 | Casper | |
| 3,494,418 | A | 2/1970 | Young | |
| 3,543,870 | A | 12/1970 | Martinsen | |
| 3,667,558 | A | 6/1972 | Lambot | |
| 3,930,679 | A * | 1/1976 | Anderson | E21B 31/18 294/86.3 |
| 3,977,482 | A | 8/1976 | Reed et al. | |
| 4,418,770 | A | 12/1983 | Lambot | |
| 4,466,497 | A | 8/1984 | Soinski et al. | |
| 4,664,204 | A | 5/1987 | Nenkov et al. | |
| 4,800,969 | A | 1/1989 | Thompson | |
| 4,823,872 | A | 4/1989 | Hopmann | |
| 4,832,138 | A | 5/1989 | Hallez | |
| 4,834,198 | A | 5/1989 | Thompson | |
| 4,930,587 | A | 6/1990 | Young et al. | |
| 5,020,612 | A | 6/1991 | Williams | |
| 5,253,720 | A | 10/1993 | Radford et al. | |
| 5,267,620 | A | 12/1993 | Lee | |
| 5,311,950 | A | 5/1994 | Spektor | |
| 5,325,930 | A | 7/1994 | Harrison | |
| 5,662,182 | A | 9/1997 | McLeod et al. | |
| 5,785,134 | A | 7/1998 | McLeod et al. | |
| 5,799,742 | A | 9/1998 | Soinski et al. | |
| 5,934,393 | A | 8/1999 | Marshall | |
| 5,992,543 | A | 11/1999 | Soinski et al. | |
| D420,013 | S | 2/2000 | Warren et al. | |
| 6,019,181 | A | 2/2000 | Soinski et al. | |
| 6,029,758 | A | 2/2000 | Novacovicci et al. | |
| 6,039,129 | A | 3/2000 | McLeod | |
| 6,059,053 | A | 5/2000 | McLeod | |
| 6,089,335 | A | 7/2000 | Able | |
| 6,371,205 | B1 | 4/2002 | Langan et al. | |
| 6,425,449 | B1 | 7/2002 | Marshall | |
| 6,564,885 | B2 | 5/2003 | Attwater | |
| 6,708,784 | B1 | 3/2004 | Borg | |
| 7,296,638 | B2 | 11/2007 | Beach et al. | |
| 7,314,101 | B2 | 1/2008 | Beach | |
| 7,363,967 | B2 | 4/2008 | Burris, II et al. | |
| 7,730,965 | B2 | 6/2010 | Jordan et al. | |
| D622,293 | S | 8/2010 | Drenth et al. | |
| D622,294 | S | 8/2010 | Drenth et al. | |
| D622,741 | S | 8/2010 | Drenth et al. | |
| D624,564 | S | 9/2010 | Drenth et al. | |
| 7,841,400 | B2 | 11/2010 | Wells et al. | |
| D632,309 | S | 2/2011 | Coyle, Jr. | |
| 7,900,716 | B2 | 3/2011 | Ibrahim et al. | |
| 7,967,085 | B2 | 6/2011 | Drenth | |
| 8,261,857 | B2 | 9/2012 | Able et al. | |
| 8,333,255 | B2 | 12/2012 | Drenth | |
| 8,485,280 | B2 | 7/2013 | Drenth et al. | |
| 8,770,322 | B2 * | 7/2014 | Drenth | E21B 25/02 175/263 |
| 2004/0216927 | A1 | 11/2004 | Beach | |
| 2005/0034894 | A1 | 2/2005 | Beach et al. | |
| 2005/0241825 | A1 | 11/2005 | Burris et al. | |
| 2009/0032256 | A1 | 2/2009 | Sun et al. | |
| 2009/0173542 | A1 | 7/2009 | Ibrahim et al. | |
| 2009/0260882 | A1 | 10/2009 | Drenth | |
| 2009/0283328 | A1 | 11/2009 | Drivdahl et al. | |
| 2011/0079435 | A1 | 4/2011 | Drenth et al. | |
| 2011/0079436 | A1 | 4/2011 | Drenth et al. | |
| 2013/0105227 | A1 | 5/2013 | Drenth | |
| 2013/0192901 | A1 | 8/2013 | Londov | |
| 2013/0313024 | A1 | 11/2013 | Drenth et al. | |

FOREIGN PATENT DOCUMENTS

| | | | |
|---|---|---|---|
| AU | 2010303446 | | 10/2010 |
| AU | 2010339878 | | 12/2010 |
| AU | 2010303446 | A1 | 5/2012 |
| AU | 2010339878 | A1 | 7/2012 |
| BR | 11 2012 008034 2 | | 10/2010 |
| BR | 11 2012 014787 0 | | 12/2010 |
| BR | 11 2012 008034 2 | | 4/2011 |
| BR | 11 2012 0147870 | | 7/2011 |
| CA | 2679933 | | 3/2008 |
| CA | 2679933 | A1 | 9/2008 |
| CA | 2776923 | | 10/2010 |
| CA | 2784532 | | 12/2010 |
| CA | 2776923 | A1 | 4/2011 |
| CA | 2784532 | A1 | 7/2011 |
| CL | 2012-00884 | | 10/2010 |
| CL | 2012-01618 | | 12/2010 |
| CL | 88412 | | 4/2011 |
| CL | 2012-01618 | | 7/2011 |
| CN | 200880007004.5 | | 3/2008 |
| CN | 101675205 | A | 3/2010 |
| CN | 201080055434.1 | | 10/2010 |
| CN | 201080057031.0 | | 12/2010 |
| CN | 10278224 | | 4/2011 |
| CN | 102791954 | A | 11/2012 |
| EP | 1757770 | A1 | 2/2007 |
| EP | 08731246.8 | | 3/2008 |
| EP | 2132395 | A1 | 12/2009 |
| EP | 10822658 | | 10/2010 |
| EP | 10842597.6 | | 12/2010 |
| EP | 2486223 | A2 | 8/2012 |
| EP | 2513413 | A2 | 10/2012 |
| GB | 992246 | A | 5/1965 |
| NZ | 599635 | | 10/2010 |
| NZ | 600697 | | 12/2010 |
| NZ | 600697 | | 7/2011 |
| NZ | 599635 | A | 9/2013 |
| PE | 446.2012 | | 10/2010 |
| PE | 823.2012 | | 12/2010 |
| PE | 446.2012 | | 4/2011 |
| PE | 823.2012 | | 7/2011 |
| WO | WO-95/03475 | A1 | 2/1995 |
| WO | WO-03/038232 | A1 | 5/2003 |
| WO | PCT/US2008/055656 | | 3/2008 |
| WO | WO-2008/109522 | A1 | 9/2008 |
| WO | WO-2009/108113 | A1 | 9/2009 |
| WO | WO-2010/096860 | A1 | 9/2010 |
| WO | PCT/US2010/051747 | | 10/2010 |
| WO | PCT/US2010/060744 | | 12/2010 |
| WO | WO-2011/044314 | A2 | 4/2011 |
| WO | WO-2011/084589 | A2 | 7/2011 |
| WO | PCT/US2014/023405 | | 3/2014 |
| ZA | 2009/05921 | | 3/2008 |
| ZA | 2009/05921 | | 9/2008 |
| ZA | 2012/03285 | | 10/2010 |
| ZA | 2012/05268 | | 12/2010 |
| ZA | 2012/03285 | | 4/2011 |
| ZA | 2012/05268 | | 7/2011 |

OTHER PUBLICATIONS

PCT/US2014/023405, Longyear TM, Inc.

International Preliminary Report on Patentability issued Sep. 8, 2009 for International Patent Application PCT/US2008/055656, which was filed on Mar. 3, 2008 and published as WO 2008/109522 on Sep. 12, 2008 (Inventor—Drenth; Applicant—Boart Longyear) (pp. 1-4).

International Search Report and Written Opinion issued Aug. 8, 2008

(56) References Cited

OTHER PUBLICATIONS for International Patent Application PCT/US2008/055656, which was filed on Mar. 3, 2008 and published as WO 2008/109522 on Sep. 12, 2008 (Inventor—Drenth; Applicant—Boart Longyear) (pp. 1-5).
Non-Final Office Action issued Aug. 1, 2011 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-8).
Amendment "A" and Response to Office Action filed Oct. 27, 2011 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-28).
Applicant Initiated Interview Summary issued Nov. 1, 2011 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-3).
Final Office Action issued Apr. 5, 2012 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-9).
Amendment and Response to Final Office Action filed Jun. 14, 2012 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-21).
Applicant Initiated Interview Summary issued Jun. 20, 2012 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-3).
Notice of Allowance issued Oct. 3, 2012 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-5).
Notice of Allowance issued Nov. 6, 2012 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-2).
Issue Notification issued Nov. 28, 2012 for U.S. Appl. No. 12/528,949, filed Aug. 27, 2009 and issued as U.S. Pat. No. 8,333,255 on Dec. 18, 2012 (Inventor—Drenth; Applicant—Longyear TM, Inc.) (pp. 1-1).
Preliminary Amendment filed Apr. 23, 2013 for U.S. Appl. No. 13/717,421, filed Dec. 17, 2012 and published as U.S. 2013/0105227 on May 2, 2013 (Inventor—Drenth; Applicant—Longyear TM, Inc.) (pp. 1-3).
International Preliminary Report on Patentability issued Apr. 11, 2012 for International Patent Application PCT/US2010/051747, which was filed Oct. 7, 2010 and published as WO 2011/044314 on Apr. 14, 2014 (Inventor—Drenth; Applicant—Longyear TM, Inc.) (pp. 1-5).
International Search Report and Written Opinion issued Jun. 10, 2011 for International Patent Application PCT/US2010/051747, which was filed Oct. 7, 2010 and published as WO 2011/044314 on Apr. 14, 2014 (Inventor—Drenth; Applicant—Longyear TM, Inc.) (pp. 1-7).
Preliminary Amendment filed Sep. 27, 2011 for U.S. Appl. No. 12/898,878, filed Oct. 6, 2010 and published as U.S. 2011/0079435 on Apr. 7, 2011 (Inventor—Drenth; Applicant—Longyear TM, Inc.) (pp. 1-10).
Restriction Requirement issued Dec. 21, 2012 for U.S. Appl. No. 12/898,878, filed Oct. 6, 2010 and published as U.S. 2011/0079435 on Apr. 7, 2011 (Inventor—Drenth; Applicant—Longyear TM, Inc.) (pp. 1-6).
Response to Restriction Requirement filed Jan. 22, 2013 for U.S. Appl. No. 12/898,878, filed Oct. 6, 2010 and published as U.S. 2011/0079435 on Apr. 7, 2011 (Inventor—Drenth; Applicant—Longyear TM, Inc.) (pp. 1-10).
Non-Final Office Action issued Apr. 26, 2013 for U.S. Appl. No. 12/898,878, filed Oct. 6, 2010 and published as U.S. 2011/0079435 on Apr. 7, 2011 (Inventor—Drenth; Applicant—Longyear TM, Inc.) (pp. 1-7).
Amendment and Response to Non-Final Office Action filed Jul. 26, 2013 for U.S. Appl. No. 12/898,878, filed Oct. 6, 2010 and published as U.S. 2011/0079435 on Apr. 7, 2011 (Inventor—Drenth; Applicant—Longyear TM, Inc.) (pp. 1-17).
Final Office Action issued Sep. 26, 2013 for U.S. Appl. No. 12/898,878, filed Oct. 6, 2010 and published as U.S. 2011/0079435 on Apr. 7, 2011 (Inventor—Drenth; Applicant—Longyear TM, Inc.) (pp. 1-7).
Amendment and Response to Final Office Action filed Jan. 27, 2014 for U.S. Appl. No. 12/898,878, filed Oct. 6, 2010 and published as U.S. 2011/0079435 on Apr. 7, 2011 (Inventor—Drenth; Applicant—Longyear TM, Inc.) (pp. 1-14).
Notice of Allowance issued Mar. 31, 2014 for U.S. Appl. No. 12/898,878, filed Oct. 6, 2010 and published as U.S. 2011/0079435 on Apr. 7, 2011 (Inventor—Drenth; Applicant—Longyear TM, Inc.) (pp. 1-5).
International Preliminary Report on Patentability issued Jun. 19, 2012 for International Patent Application PCT/US2010/060744, which was filed on Dec. 16, 2010 and published as WO 2011/084589 on Jul. 14, 2011 (Inventor—Drenth; Applicant—Longyear TM, Inc.) (pp. 1-4).
International Search Report and Written Opinion issued Jul. 27, 2011 for International Patent Application PCT/US2010/060744, which was filed on Dec. 16, 2010 and published as WO 2011/084589 on Jul. 14, 2011 (Inventor—Drenth; Applicant—Longyear TM, Inc.) (pp. 1-6).
Non-Final Office Action issued Aug. 6, 2012 for U.S. Appl. No. 12/968,127, filed Dec. 14, 2010 and issued as U.S. Pat. No. 8,485,280 on Jul. 16, 2013 (Inventor—Drenth; Applicant—Longyear TM, Inc.) (pp. 1-9).
Amendment in Response to Non-Final Office Action filed Nov. 5, 2012 for U.S. Appl. No. 12/968,127, filed Dec. 14, 2010 and issued as U.S. Pat. No. 8,485,280 on Jul. 16, 2013 (Inventor—Drenth; Applicant—Longyear TM, Inc.) (pp. 1-13).
Final Office Action issued Dec. 21, 2012 for U.S. Appl. No. 12/968,127, filed Dec. 14, 2010 and issued as U.S. Pat. No. 8,485,280 on Jul. 16, 2013 (Inventor—Drenth; Applicant—Longyear TM, Inc.) (pp. 1-10).
Amendment in Response to Final Office Action filed Feb. 21, 2013 for U.S. Appl. No. 12/968,127, filed Dec. 14, 2010 and issued as U.S. Pat. No. 8,485,280 on Jul. 16, 2013 (Inventor—Drenth; Applicant—Longyear TM, Inc.) (pp. 1-16).
Supplemental Amendment filed Mar. 1, 2013 for U.S. Appl. No. 12/968,127, filed Dec. 14, 2010 and issued as U.S. Pat. No. 8,485,280 on Jul. 16, 2013 (Inventor—Drenth; Applicant—Longyear TM, Inc.) (pp. 1-9).
Notice of Allowance, Examiner Interview Summary, and Examiner's Amendment filed Mar. 15, 2013 for U.S. Appl. No. 12/968,127, filed Dec. 14, 2010 and issued as U.S. Pat. No. 8,485,280 on Jul. 16, 2013 (Inventor—Drenth; Applicant—Longyear TM, Inc.) (pp. 1-8).
Issue Notification issued Jun. 26, 2013 for U.S. Appl. No. 12/968,127, filed Dec. 14, 2010 and issued as U.S. Pat. No. 8,485,280 on Jul. 16, 2013 (Inventor—Drenth; Applicant—Longyear TM, Inc.) (pp. 1-1).
Notice of Allowance and Examiner's Amendment issued Aug. 1, 2011 for U.S. Appl. No. 29/383,554, filed Jan. 19, 2011 and issued as U.S. Pat. No. D649,167 (Inventor—Drenth; Applicant—Longyear TM, Inc.) (pp. 1-7).
Notice of Allowance issued Sep. 20, 2011 for U.S. Appl. No. 29/383,554, filed Jan. 19, 2011 and issued as U.S. Patent D649,167 (Inventor—Drenth; Applicant—Longyear TM, Inc.) (pp. 1-7).
Notice of Allowance issued Oct. 17, 2011 for U.S. Appl. No. 29/383,554, filed Jan. 19, 2011 and issued as U.S. Pat. No. D649,167 (Inventor—Drenth; Applicant—Longyear TM, Inc.) (pp. 1-2).
Issue Notification issued Nov. 2, 2011 for U.S. Appl. No. 29/383,554, filed Jan. 19, 2011 and issued as U.S. Pat. No. D649,167 (Inventor—Drenth; Applicant—Longyear TM, Inc.) (pp. 1-1).
Notice of Allowance and Examiner's Amendment issued Aug. 25, 2011 for U.S. Appl. No. 13/094,581, filed Apr. 26, 2011 and issued as U.S. Pat. No. 8,051,925 on Nov. 8, 2011 (Inventor—Drenth; Applicant—Longyear TM, Inc.) (pp. 1-8).

(56) References Cited

OTHER PUBLICATIONS

Issue Notification issued Oct. 19, 2011 for U.S. Appl. No. 13/094,581, filed Apr. 26, 2011 and issued as U.S. Pat. No. 8,051,925 on Nov. 8, 2011 (Inventor—Drenth; Applicant—Longyear TM, Inc.) (pp. 1-1).
Notice of Allowance issued Aug. 19, 2011 for U.S. Appl. No. 13/094,674, filed Apr. 26, 2011 and issued as U.S. Pat. No. 8,051,924 on Nov. 8, 2011 (Inventor—Drenth; Applicant—Longyear TM, Inc.) (pp. 1-4).
Issue Notification issued Oct. 19, 2011 for U.S. Appl. No. 13/094,674, filed Apr. 26, 2011 and issued as U.S. Pat. No. 8,051,924 on Nov. 8, 2011 (Inventor—Drenth; Applicant—Longyear TM, Inc.) (pp. 1-1).
Notice of Allowance issued Apr. 6, 2011 for U.S. Appl. No. 29/383,340, filed Jan. 14, 2011 and issued as U.S. Pat. No. D644,668 on Sep. 6, 2011 (Inventor—Drenth; Applicant—Longyear TM, Inc.) (pp. 1-7).
Supplemental Notice of Allowance issued Jul. 11, 2011 for U.S. Appl. No. 29/383,340, filed Jan. 14, 2011 and issued as U.S. Pat. No. D644,668 on Sep. 6, 2011 (Inventor—Drenth; Applicant—Longyear TM, Inc.) (pp. 1-2).
Issue Notification issued Aug. 17, 2011 for U.S. Appl. No. 29/383,340, filed Jan. 14, 2011 and issued as U.S. Pat. No. D644,668 on Sep. 6, 2011 (Inventor—Drenth; Applicant—Longyear TM, Inc.) (pp. 1-1).
Notice of Allowance and Examiner's Amendment issued May 26, 2011 for U.S. Appl. No. 29/383,623, filed Jan. 20, 2011 and issued as U.S. Pat. No. D647,540 on Oct. 25, 2011 (Inventor—Drenth; Applicant—Longyear TM, Inc.) (pp. 1-7).
Notice of Allowance issued Aug. 4, 2011 for U.S. Appl. No. 29/383,623, filed Jan. 20, 2011 and issued as U.S. Pat. No. D647,540 on Oct. 25, 2011 (Invento—Drenth; Applicant—Longyear TM, Inc.) (pp. 1-7).
Issue Notification issued Oct. 5, 2011 for U.S. Appl. No. 29/383,623, filed Jan. 20, 2011 and issued as U.S. Pat. No. D647,540 on Oct. 25, 2011 (Inventor—Drenth; Applicant—Longyear TM, Inc.) (pp. 1-1).
International Search Report and Written Opinion issued Jul. 27, 2011 for International Patent Application PCT/US2010/060742, which was filed on Dec. 16, 2010 and published as WO 2011/084587 on Jul. 14, 2011 (Inventor—Drenth; Applicant—Longyear TM, Inc.) (pp. 1-6).
Notice of Allowance issued Apr. 6, 2011 for U.S. Appl. No. 29/383,561, filed Jan. 19, 2011 and issued as U.S. Pat. No. D643,859 on Aug. 23, 2011 (Inventor—Drenth; Applicant—Longyear TM, Inc.) (pp. 1-7).
Supplemental Notice of Allowance issued Jul. 11, 2011 for U.S. Appl. No. 29/383,561, filed Jan. 19, 2011 and issued as U.S. Pat. No. D643,859 on Aug. 23, 2011 (Inventor—Drenth; Applicant—Longyear TM, Inc.) (pp. 1-2).
Issue Notification issued Aug. 3, 2011 for U.S. Appl. No. 29/383,561, filed Jan. 19, 2011 and issued as U.S. Pat. No. D643,859 on Aug. 23, 2011 (Inventor—Drenth; Applicant—Longyear TM, Inc.) (pp. 1-1).
Notice of Allowance issued Apr. 8, 2011 for U.S. Appl. No. 29/383,572, filed Jan. 19, 2011 and issued as U.S. Pat. No. D643,443 on Aug. 16, 2011 (Inventor—Drenth; Applicant—Longyear TM, Inc.) (pp. 1-7).
Issue Notification issued Jul. 27, 2011 for U.S. Appl. No. 29/383,572, filed Jan. 19, 2011 and issued as U.S. Pat. No. D643,443 on Aug. 16, 2011 (Inventor—Drenth; Applicant—Longyear TM, Inc.) (pp. 1-1).
Non-Final Office Action issued Jan. 6, 2011 for U.S. Appl. No. 12/427,586, filed Apr. 21, 2009 and issued as U.S. Pat. No. 7,967,085 on Jun. 28, 2011 (Inventor—Drenth; Applicant—Longyear TM, Inc.) (pp. 1-13).
Notice of Allowance issued Feb. 25, 2011 for U.S. Appl. No. 12/427,586, filed Apr. 21, 2009 and issued as U.S. Pat. No. 7,967,085 on Jun. 28, 2011 (Inventor—Drenth; Applicant—Longyear TM, Inc.) (pp. 1-7).
Issue Notification issued Jun. 28, 2011 for U.S. Appl. No. 12/427,586, filed Apr. 21, 2009 and issued as U.S. Pat. No. 7,967,085 on Jun. 28, 2011 (Inventor—Drenth; Applicant—Longyear TM, Inc.) (pp. 1-1).
International Search Report and Written Opinion issued Oct. 28, 2009 for International Patent Application PCT/US2009/041435, which was filed on Apr. 22, 2009 and published as WO 2009/132125 on Oct. 29, 2009 (Inventor—Drenth; Applicant—Longyear TM, Inc.) (pp. 1-6).
U.S. Appl. No. 60/892,848, filed Mar. 3, 2007, Drenth (Longyear TM, Inc.).
U.S. Appl. No. 61/249,544, filed Oct. 7, 2009, Drenth (Longyear TM, Inc.).
U.S. Appl. No. 61/287,106, filed Dec. 16, 2009, Drenth (Longyear TM, Inc.).
Non-Final Office Action issued by the U.S. Patent & Trademark Office on Jun. 5, 2015 for U.S. Appl. No. 13/943,460, filed Jul. 16, 2013 and published as US-2013-0313024-A1 on Nov. 28, 2013 (Inventor—Drenth, et al. // Applicant—Boart Longyear) (7 pages).
Extended European Search Report issued by the European Patent Office on Jun. 26, 2015 for application EP 08731246.8, filed on Mar. 3, 2008 (Applicant—Boart Longyear // InventorDrenth) (5 pages).
Final Office Action issued on Nov. 17, 2015 for U.S. Appl. No. 13/717,421, filed Dec. 17, 2012 and published as US-2013-0105227-A1 on May 2, 2013 (Applicant—Boart Longyear // Inventor—Drenth) (7 pages).

* cited by examiner

CORE DRILLING TOOLS WITH RETRACTABLY LOCKABLE DRIVEN LATCH MECHANISMS

CROSS-REFERENCE TO RELATED APPLICATIONS

This application is a continuation-in-part of U.S. patent application Ser. No. 13/943,460, filed Jul. 16, 2013, issued as U.S. Pat. No. 9,234,398 on Jan. 12, 2016, which is a continuation of U.S. patent application Ser. No. 12/968,127, filed Dec. 14, 2010, issued as U.S. Pat. No. 8,485,280 on Jul. 16, 2013, which claims priority to and the benefit of U.S. Provisional Application No. 61/287,106, filed Dec. 16, 2009, entitled "Driven Latch Mechanism for High Productivity Core Drilling," and which is a continuation-in-part of U.S. patent application Ser. No. 12/898,878, filed on Oct. 6, 2010, issued as U.S. Pat. No. 8,794,355 Aug. 5, 2014, and entitled "Driven Latch Mechanism," which claims priority to and the benefit of U.S. Provisional Application No. 61/249,544, filed Oct. 7, 2009, entitled "Driven Latch Mechanism" and U.S. Provisional Application No. 61/287,106, filed Dec. 16, 2009, entitled "Driven Latch Mechanism for High Productivity Core Drilling." This application is also a continuation-in-part of U.S. patent application Ser. No. 13/593,338, filed Aug. 23, 2012, which issues as a U.S. Pat. No. 8,770,322 on Jul. 8, 2014. The contents of the above-referenced patent applications are hereby incorporated by reference in their entirety.

FIELD

Implementations of the present invention relate generally to drilling devices and methods that may be used to drill geological and/or manmade formations. In particular, implementations of the present invention relate to core barrel assemblies having driven latch mechanisms.

BACKGROUND

Core drilling (or core sampling) includes obtaining core samples of subterranean formations at various depths for various reasons. For example, a retrieved core sample can indicate what materials, such as petroleum, precious metals, and other desirable materials, are present or are likely to be present in a particular formation, and at what depths. In some cases, core sampling can be used to give a geological timeline of materials and events. As such, core sampling may be used to determine the desirability of further exploration in a particular area.

Wireline drilling systems are one common type of drilling system for retrieving a core sample. In a wireline drilling process, a core drill bit is attached to the leading edge of an outer tube or drill rod. A drill string is then formed by attaching a series of drill rods that are assembled together section by section as the outer tube is lowered deeper into the desired formation. A core barrel assembly is then lowered or pumped into the drill string. The core drill bit is rotated, pushed, and/or vibrated into the formation, thereby causing a sample of the desired material to enter into the core barrel assembly. Once the core sample is obtained, the core barrel assembly is retrieved from the drill string using a wireline. The core sample can then be removed from the core barrel assembly.

Core barrel assemblies commonly include a core barrel for receiving the core, and a head assembly for attaching the core barrel assembly to the wireline. Typically, the core barrel assembly is lowered into the drill string until the core barrel reaches a landing seat on an outer tube or distal most drill rod.

At this point a latch on the head assembly is deployed to restrict the movement of the core barrel assembly with respect to the drill rod. Once latched, the core barrel assembly is then advanced into the formation along with the drill rod, causing material to fill the core barrel.

One potential challenge can arise due to the interaction between the core barrel assembly and the drill string. For example, when the drill string is spinning, the inertia of the core barrel assembly can exceed the frictional resistance between the mating components such that the head assembly rotates at a lower rate than the drill rod or fails to rotate and remains stationary. In such a situation, the mating components can suffer sliding contact, which can result in abrasive wear.

Often it may be desirable to obtain core samples at various depths in a formation. Furthermore, in some cases, it may be desirable to retrieve core samples at depths of thousands of feet below ground-level, or otherwise along a drilling path. In such cases, retrieving a core sample may require the time consuming and costly process of removing the entire drill string (or tripping the drill string out) from the borehole. In other cases, a wireline drilling system may be used to avoid the hassle and time associated with tripping the entire drill string. Even when using a wireline drilling system, tripping the core barrel assembly in and out of the drill string is nonetheless time-consuming.

Accordingly, there are a number of disadvantages in conventional wireline systems that can be addressed.

There is a further need for core barrel head assemblies that provide improved tripping speed during descent into a drill string. Thus, there is a need for core barrel head assemblies that include mechanisms for (a) allowing standing fluid to pass through an inner tube for purposes of reducing drag during tripping of the head assembly into a hole while also (b) preventing drilling supply fluid from passing into the inner tube and damaging a core sample.

There is still a further need for core barrel head assemblies that provide for improved fluid control during all drilling conditions. Thus, there is a need for core barrel head assemblies that include mechanisms for reliably creating pressure change signals that are detectable by a drill operator and for ensuring fluid communication between a drill rig and a drill bit, particularly during "lost circulation" conditions when it is crucial to avoid a loss of fluid pressure.

Conventional core barrel head assemblies are not equipped with mechanisms for—and are incapable of—meeting all of these needs in a single assembly configuration. Instead, multiple configurations are required, thereby increasing the costs and complexity of manufacturing, inventory logistics, and operator training. Accordingly, there is a need in the pertinent art for a single core barrel head assembly configuration that is configured to provide for both improved tripping speed and improved fluid control under all drilling conditions.

An operator of a conventional core barrel head assembly typically relies upon deployment of a valve piston through an indicator bushing to generate a pressure signal that indicates a drilling position has been achieved. However, this pressure signal can only occur after the latch retracting case drops (following deployment of the latch mechanism). However, under non-ideal drilling conditions, such as those that occur during angled drilling, under adverse pump conditions, at excessive drilling depths, and/or under adverse ground conditions, there may be insufficient inertia or pressure to effect deployment of the valve piston. Thus, there is a need for alternative means for ensuring that latch deployment occurs, particularly under adverse drilling conditions.

SUMMARY

One or more implementations of the present invention overcome one or more problems in the art with drilling tools, systems, and methods for effectively and efficiently obtaining core samples. For example, one or more implementations of the present invention include a core barrel assembly having a driven latch mechanism that can reliably lock the core barrel assembly axially and rotationally to a drill string. Additionally, the driven latch mechanism can be radially refracted and locked within a retracted position during tripping of the core barrel assembly in and out of the drill string. The retracted position of the driven latch mechanism during tripping of the core barrel assembly can allow for greater fluid flow between the drill string and the core barrel assembly; and thus, faster tripping of the core barrel assembly.

For example, one implementation of a core barrel head assembly includes a sleeve having a plurality of openings extending there through. The core barrel head assembly can also include a plurality of wedge members positioned at least partially within the plurality of openings. The plurality of wedge members can be adapted to axially and rotationally lock the sleeve relative to a drill string. Additionally, the core barrel head assembly can include a driving member positioned at least partially within the sleeve. The driving member can include at least one groove extending therein. The at least one groove can be configured to receive and maintain said plurality of wedge members in a retracted position within the sleeve.

Additionally, another implementation of a core barrel head assembly can include a sleeve and a driving member moveably coupled to the sleeve. The core barrel head assembly can also include a plurality of wedge members positioned on the driving member. Axial movement of the driving member relative to the sleeve can move the plurality of wedge members radially relative to the sleeve between a latched position and a retracted position. Further, the core barrel head assembly can include at least one groove extending into the driving member. The at least one groove can receive and lock the plurality of wedge members in the retracted position.

Furthermore, an implementation of a drilling system for retrieving a core sample can include a drill string comprising a plurality of drill rods. The drilling system can also include a core barrel assembly adapted to be inserted within the drill string. Additionally, the drilling system can include a driven latch mechanism positioned within the core barrel assembly. The driven latch mechanism can rotationally and axially lock the core barrel assembly relative to the drill string. The driven latch mechanism can include a plurality of wedge members positioned on a driving member. The driving member can include at least one groove adapted to receive and lock the plurality of wedge members relative to the driving member.

In addition to the foregoing, a method of drilling using a core barrel assembly comprising a sleeve, a driving member, and a plurality of wedge members can involve manipulating the core barrel assembly to position the plurality of wedge members into at least one retracted groove on the driving member. The at least one retracted groove can hold the plurality of wedge members radially within said sleeve. The method can also involve inserting the core barrel assembly within a drill string. Additionally, the method can involve sending the core barrel assembly along the drill string to a drilling position.

In some exemplary aspects, upon reaching the drilling position, the plurality of wedge members can move out of the at least one refracted groove into a deployed position in which the plurality of wedge members extend at least partially radially outward of the sleeve. Still further the method can involve rotating the drill string thereby causing the plurality of wedge members to wedge between an inner surface of the drill string and the driving member. The wedging of the plurality of wedge members between an inner surface of the drill string and the driving member can rotationally lock the core barrel assembly relative to the drill string.

In other exemplary aspects, upon reaching the drilling position, the method of drilling can include spinning the drill string to cause the core barrel head assembly to spin through the frictional mating of a landing shoulder of the head assembly and a landing ring of an outer tube assembly. The spinning of the drill string can induce a centrifugal and/or radial force that acts on the wedge members to overcome the frictional retention forces in the retracted position/groove created by the biasing member, thereby permitting deployment of the wedge members. Further rotation of the drill string can cause the wedge members to wedge between the inner surface of the drill string and the driving member, thereby rotationally locking the core barrel head assembly relative to the drill string.

In another exemplary aspect, described herein is a core barrel head assembly configured to be removably received within a drill string. The core barrel head assembly can comprise a sleeve having a plurality of openings and a plurality of wedge members positioned at least partially within respective openings of the plurality of openings. The core barrel head assembly can further comprise a driving member having an outer surface defining a plurality of driving surfaces spaced circumferentially about the outer surface. The driving member can be positioned at least partially within the sleeve. The driving member can comprise at least one first groove that is configured to receive and maintain the plurality of wedge members in a retracted position within the sleeve. Within the at least one first groove, the plurality of wedge members can be retained in the retracted position by a retention force. The core barrel head assembly can further comprise a biasing member configured apply a biasing force to bias the driving member against the plurality of wedge members. The core barrel head assembly can still further comprise a landing portion defining a landing shoulder, the landing shoulder configured for frictional engagement with a landing ring of an outer tube. During the frictional engagement between the landing shoulder and the landing ring of the outer tube, the core barrel head assembly can be configured to rotate with the drill string, and the rotation of the drill string can be configured to produce a centrifugal force that overcomes the retention force, thereby causing the wedge members to extend radially outward of the sleeve into the annular groove in the inner surface of the drill string.

Also described herein is a latch body for use in a drilling head assembly. The drilling head assembly can include a fluid control subassembly, a check valve element, and/or a hollow spindle. The latch body can have a longitudinal axis, a longitudinal length, a proximal end portion, and a distal end portion. The latch body can define a central bore extending along the longitudinal length of the latch body through the proximal and distal end portions of the latch body.

The distal end portion of the latch body can include a port section that defines a chamber in fluid communication with the central bore. The port section can further define at least one port in fluid communication with the chamber. The chamber of the port section can be configured to receive at least a portion of the check valve element of the drilling head assembly. The chamber of the port section can have an inner surface configured to promote movement of the check valve element between a blocking position in which fluid flow through at least a portion of the chamber of the port section is blocked and an open position in which fluid flow through the chamber is permitted. The hollow spindle of the fluid control subassembly can be operatively coupled to, and positioned in fluid communication with, the chamber of the port section. The hollow spindle can be configured to support the check valve element in the blocking position. The latch body can further include a spring at least partially received within the chamber of the port section that is configured to bias the check valve element in the blocking position.

The proximal end portion of the latch body can be configured to support the fluid control subassembly of the drilling head assembly in an operative position. The fluid control subassembly can have a common longitudinal axis with the latch body. The fluid control subassembly can include a valve member configured for movement relative to the common longitudinal axis. The fluid control assembly can further include a spring positioned in abutting relation to the valve member and the proximal end portion of the latch body such that the spring is biased against the valve member.

The latch body can include a plurality of male protrusions extending inwardly toward and spaced from the longitudinal axis of the latch body. Each protrusion of the plurality of male protrusions can have a leading end spaced a selected distance from the longitudinal axis of the latch body. The latch body can also include a plurality of channels extending radially outwardly from the longitudinal axis of the latch body. Each channel of the plurality of channels can span between the leading ends of adjacent male protrusions.

Methods of using the described latch body and drilling head assembly are also disclosed.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. It should be noted that the figures are not drawn to scale, and that elements of similar structure or function are generally represented by like reference numerals for illustrative purposes throughout the figures. Understanding that these drawings depict only typical embodiments of the invention and are not therefore to be considered to be limiting of its scope, the invention will be described and explained with additional specificity and detail through the use of the accompanying drawings in which:

FIGS. 10-12 is used to display the orientation and surface geometry of various components of the exemplary drilling head assemblies.

FIG. 10 displays an exemplary drilling head assembly having a spring-biased fluid control subassembly and a spring-biased check valve element.

FIG. 11 displays an exemplary drilling head assembly having a spring-biased fluid control subassembly and a gravity-biased check valve element.

FIG. 12 displays an exemplary drilling head assembly having a fluid-drag-biased fluid control element and a gravity-biased check valve element.

DETAILED DESCRIPTION

Figure 1:
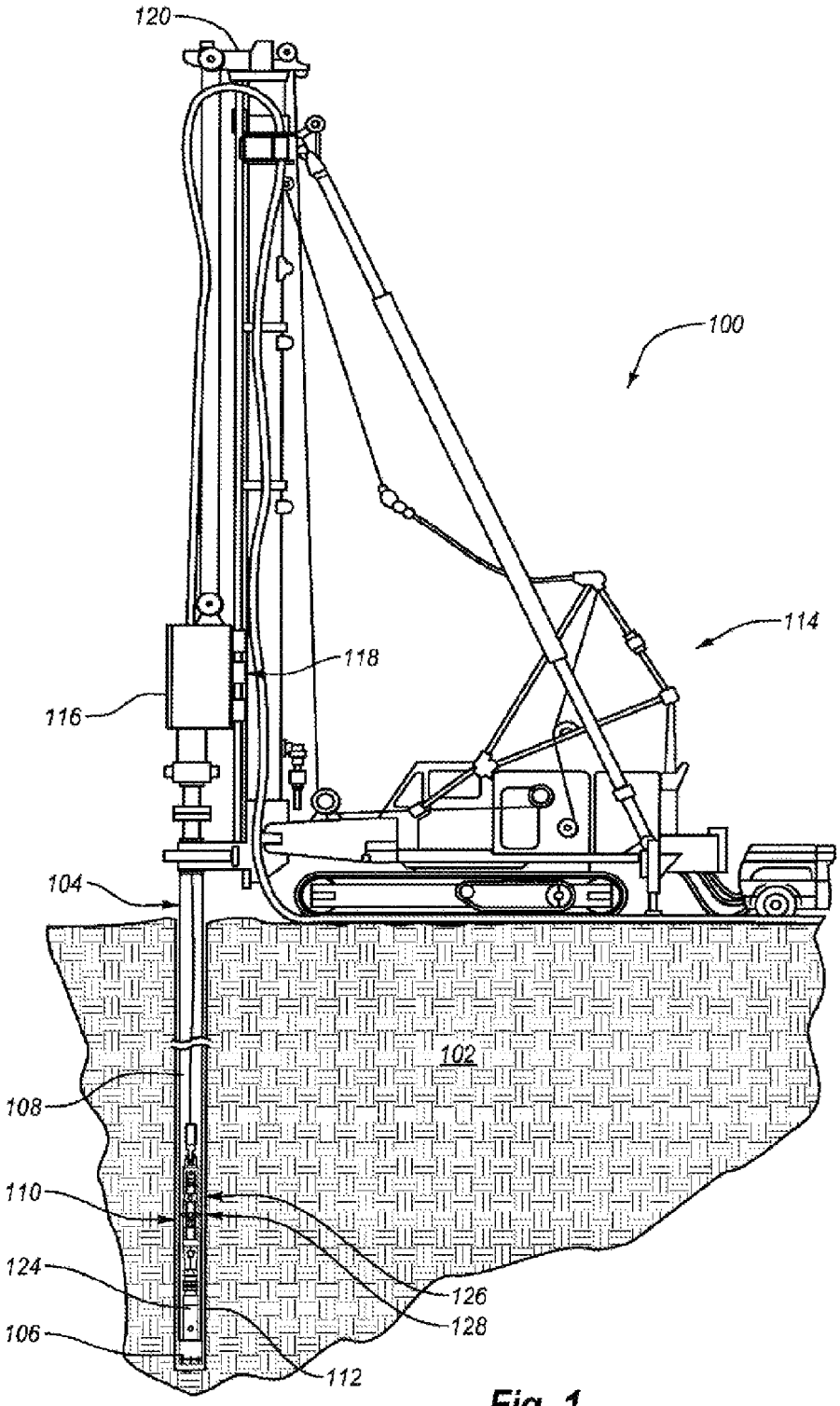
FIG. 1 illustrates a schematic view a drilling system including a core barrel assembly having a driven latch mechanism in accordance with an implementation of the present invention.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof. For instance, while the description below focuses on a drilling system used to trip a core barrel assembly into and out of a drill string, portions of the described system can be used with any suitable downhole or uphole tool, such as a core sample orientation measuring device, a hole direction measuring device, a drill hole deviation device, or any other suitable downhole or uphole object.

As used throughout, the singular forms "a," "an" and "the" include plural referents unless the context clearly dictates otherwise. Thus, for example, reference to "an inner tube" can include two or more such inner tubes unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

As used herein, the term "trip" or "tripping" refers to the periods of a drilling operation during which: (a) an empty inner tube assembly (not containing a sample) is advanced into a drill hole until the inner tube assembly reaches the bottom and/or end of the hole; or (b) a full inner tube assembly (containing a sample) is retrieved from the bottom and/or end of the hole. For example, tripping can refer to the dropping and/or lowering of an empty inner tube assembly into a down-angled hole until the inner tube assembly reaches a drilling position, the pumping of an empty inner tube assembly into an inclined hole until the inner tube assembly reaches a drilling position, as well as the wireline retrieval of a fully inner tube assembly from the drilling position until the inner tube assembly exits the hole. In exemplary applications, the inner tube assembly can comprise a head assembly, an inner tube, a core lifer, and a case.

Disclosed herein are core barrel assemblies having driven latch mechanisms and/or latch bodies, as further described below. In exemplary aspects, the core barrel assemblies have a driven latch mechanism as disclosed herein and a latch body as disclosed herein.

Also disclosed herein are systems and methods for deploying the latch mechanism of a core barrel assembly without relying on the inertia from the impact of an inner tube assembly upon landing, and without the need for applying drilling supply fluid pressure. As further disclosed herein, the disclosed systems and methods for deploying the latch mechanism can comprise twisting and/or spinning a drill string (and core barrel assembly) to deploy the latch mechanism. Initially, frictional engagement between the head assembly and the landing ring causes rotation of the head assembly with the drill string, and this rotation generates the centrifugal force necessary to fully deploy the latch mechanism (e.g., wedge members) into a deployed, wedging position. The disclosed drilling systems and methods can require less initial friction than traditional designs because there is no drag from the wedge members until they deploy. It is contemplated that the disclosed systems and methods can be particularly suited for drilling angled holes or for use under other conditions when tripping speed is reduced by increased drag, which can thereby reduce the inertia created upon landing to the point that the latch mechanism remains retracted or otherwise does not sufficiently deploy. The disclosed systems and methods address these deficiencies by permitting latch deployment without relying on the inertia from the impact of the inner tube assembly upon landing. It is further contemplated that these systems and methods can be particularly useful (a) during adverse pump conditions that limit performance, (b) at excessive drilling depths, and/or (c) during adverse ground conditions that cause excessive fluid flow resistance. In these environments, there is often insufficient fluid pressure or flow to act on the valve piston and deploy the latch mechanism. The disclosed systems and methods address these deficiencies of conventional systems and methods by permitting latch deployment without the need for the supply of fluid pressure.

The Driven Latch Mechanism

Implementations of the present invention are directed toward drilling tools, systems, and methods for effectively and efficiently obtaining core samples. For example, one or more implementations of the present invention include a core barrel assembly having a driven latch mechanism that can reliably lock the core barrel assembly axially and rotationally to a drill string. Additionally, the driven latch mechanism can be radially retracted and locked within a retracted position during tripping of the core barrel assembly in and out of the drill string. The retracted position of the driven latch mechanism during tripping of the core barrel assembly can allow for greater fluid flow between the drill string and the core barrel assembly; and thus, faster tripping of the core barrel assembly.

In particular, by locking the driven latch mechanism in a radially retracted position, the driven latch mechanism can be prevented from dragging along the inner surfaces of the drill string as the core barrel assembly is during tripped in and out of the drill string. Additionally, the latch mechanism can be prevented from impinging upon transitional inner surfaces of the drill string where the drill string has a variable cross section. Furthermore, by locking the driven latch mechanism in a radially retracted position, the space between the outer surfaces of the core barrel assembly and the drill string can be increased; thereby allowing for easier passage of drilling fluid or ground water that may be present during tripping of the core barrel assembly. Accordingly, one or more implementations of the present invention can increase productivity and efficiency in core drilling operations by reducing the time required for the core barrel assembly to travel through the drill string.

Assemblies, systems, and methods of one or more implementations can include or make use of a driven latch mechanism for securing a core barrel assembly at a desired position within a tubular member, such as a drill rod of a drill string. The driven latch mechanism can include a plurality of wedge members, and a driving member having a plurality of driving surfaces. The driving surfaces can drive the wedge members to interact with an inner surface of a drill rod to latch or lock the core barrel assembly in a desired position within the drill string. Thereafter, rotation of the drill rod can cause the wedge members to wedge between the drive surfaces and the inner diameter of the drill rod, thereby rotationally locking the core barrel relative to the drill string.

Furthermore, one or more implementations provide a driven latch mechanism that can maintain a deployed or latched condition despite vibration and inertial loading of mating head assembly components due to drilling operations or abnormal drill string movement. Also, one or more implementations can provide a latch mechanism that does not disengage or retract unintentionally, and thus prevents the core barrel inner tube assembly from rising from the drilling position in a down-angled hole.

In one or more implementations, a biasing member can be used to move the wedge members to the appropriate axial positions on the driving surfaces. The driving surfaces can have one or more features, such as grooves, to maintain or lock the wedge members at one or more desired axial positions. These desired axial positions can correspond to a deployed state and/or a retracted state, as alluded to earlier. When in the deployed state, the wedge members can be positioned to engage the drill string. On the other hand, when in the retracted state, the wedge members can be retracted from engagement with the drill string. Such a configuration can help reduce friction between the wedge members and the drill string; and thereby, increase the speed with which the assembly can be tripped in and out of the drill string.

For ease of reference, the driven latch mechanism shall be described with generally planar driving surfaces and spherical or ball-shaped wedge members. It will be appreciated that the driving members can have any number of driving surfaces with any desired shape, including, but not limited to, convex, concave, patterned or any other shape or configuration capable of wedging a wedge member as desired. Further, the wedge members can have any shape and configuration possible. In at least one example, a universal-type joint can replace the generally spherical wedge members, tapered planar drive surfaces, and accompanying sockets. Thus, the present invention can be embodied in other specific forms without departing from its spirit or essential characteristics. The described implementations are to be considered in all respects only as illustrative and not restrictive.

In other words, the following description supplies specific details in order to provide a thorough understanding of the invention. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any other apparatus and techniques. For example, while the description below focuses on core sampling operations, the apparatus and associated methods could be equally applied in other drilling processes, such as in conventional borehole drilling, and may be used with any number or varieties of drilling systems, such as rotary drill systems, percussive drill systems, etc.

Further, while the Figures show five wedge members in the latching mechanism, any number of latches may be used. In at least one example, six ball-shaped wedge members will be used in a driven latch mechanism. Similarly, the precise configuration of components as illustrated may be modified or rearranged as desired by one of ordinary skill. Additionally, while the illustrated implementations specifically discuss a wireline system, any retrieval system may be used.

As shown in FIG. 1, a drilling system 100 may be used to retrieve a core sample from a formation 102. The drilling system 100 may include a drill string 104 that may include a drill bit 106 (for example, an open-faced drill bit or other type of drill bit) and/or one or more drill rods 108. The drilling system 100 may also include an in-hole assembly, such as a core barrel assembly 110. The core barrel assembly 110 can include a driven latch mechanism 128 configured to lock the core barrel assembly at least partially within a distal drill rod or outer tube 112, as explained in greater detail below. As used herein the terms "down" and "distal end" refer to the end of the drill string 104 including the drill bit 106. While the terms "up" or "proximal" refer to the end of the drill string 104 opposite the drill bit 106.

The drilling system 100 may include a drill rig 114 that may rotate and/or push the drill bit 106, the core barrel assembly 110, the drill rods 108 and/or other portions of the drill string 104 into the formation 102. The drill rig 114 may include, for example, a rotary drill head 116, a sled assembly 118, and a mast 120. The drill head 116 may be coupled to the drill string 104, and can allow the rotary drill head 116 to rotate the drill bit 106, the core barrel assembly 110, the drill rods 108 and/or other portions of the drill string 104. If desired, the rotary drill head 116 may be configured to vary the speed and/or direction that it rotates these components. The sled assembly 118 can move relative to the mast 120. As the sled assembly 118 moves relative to the mast 120, the sled assembly 118 may provide a force against the rotary drill head 116, which may push the drill bit 106, the core barrel assembly 110, the drill rods 108 and/or other portions of the drill string 104 further into the formation 102, for example, while they are being rotated.

It will be appreciated, however, that the drill rig 114 does not require a rotary drill head, a sled assembly, a slide frame or a drive assembly and that the drill rig 114 may include other suitable components. It will also be appreciated that the drilling system 100 does not require a drill rig and that the drilling system 100 may include other suitable components that may rotate and/or push the drill bit 106, the core barrel assembly 110, the drill rods 108 and/or other portions of the drill string 104 into the formation 102. For example, sonic, percussive, or down hole motors may be used.

The core barrel assembly 110 may include an inner tube or core barrel 124, and a head assembly 126. The head assembly 126 can include a driven latch mechanism 128. As explained in greater detail below, the driven latch mechanism 128 can lock the core barrel 124 within the drill string 104, and particularly to the outer tube 112. Furthermore, the driven latch mechanism 128 can rotationally lock the core barrel assembly 110 to the drill string 104 thereby preventing wear due to rotation or sliding between the mating components of the driven latch mechanism 128 and the drill string 104.

Once the core barrel 124 is locked to the outer tube 112 via the driven latch mechanism 128, the drill bit 106, the core barrel assembly 110, the drill rods 108 and/or other portions of the drill string 104 may be rotated and/or pushed into the formation 102 to allow a core sample to be collected within the core barrel 124. After the core sample is collected, the core barrel assembly 110 may be unlocked from the outer tube 112 and drill string 104. The core barrel assembly 110 may then be retrieved, for instance using a wireline retrieval system, while the drill bit 106, the outer tube 112, one or more of the drill rods 108 and/or other portions of the drill string 104 remain within the borehole.

The core sample may be removed from core barrel 124 of the retrieved core barrel assembly 110. After the core sample is removed, the core barrel assembly 110 may be sent back and locked to the outer tube 112. With the core barrel assembly 110 once again locked to the outer tube 112, the drill bit 106, the core barrel assembly 110, the drill rods 108 and/or other portions of the drill string 104 may be rotated and/or pushed further into the formation 102 to allow another core sample to be collected within the core barrel 124. The core barrel assembly 110 may be repeatedly retrieved and sent back in this manner to obtain several core samples, while the drill bit 106, the outer tube 112, one or more of the drill rods 108 and/or other portions of the drill string 104 remain within the borehole. This may advantageously reduce the time necessary to obtain core samples because the drill string 104 need not be tripped out of the borehole for each core sample.

Figure 2:
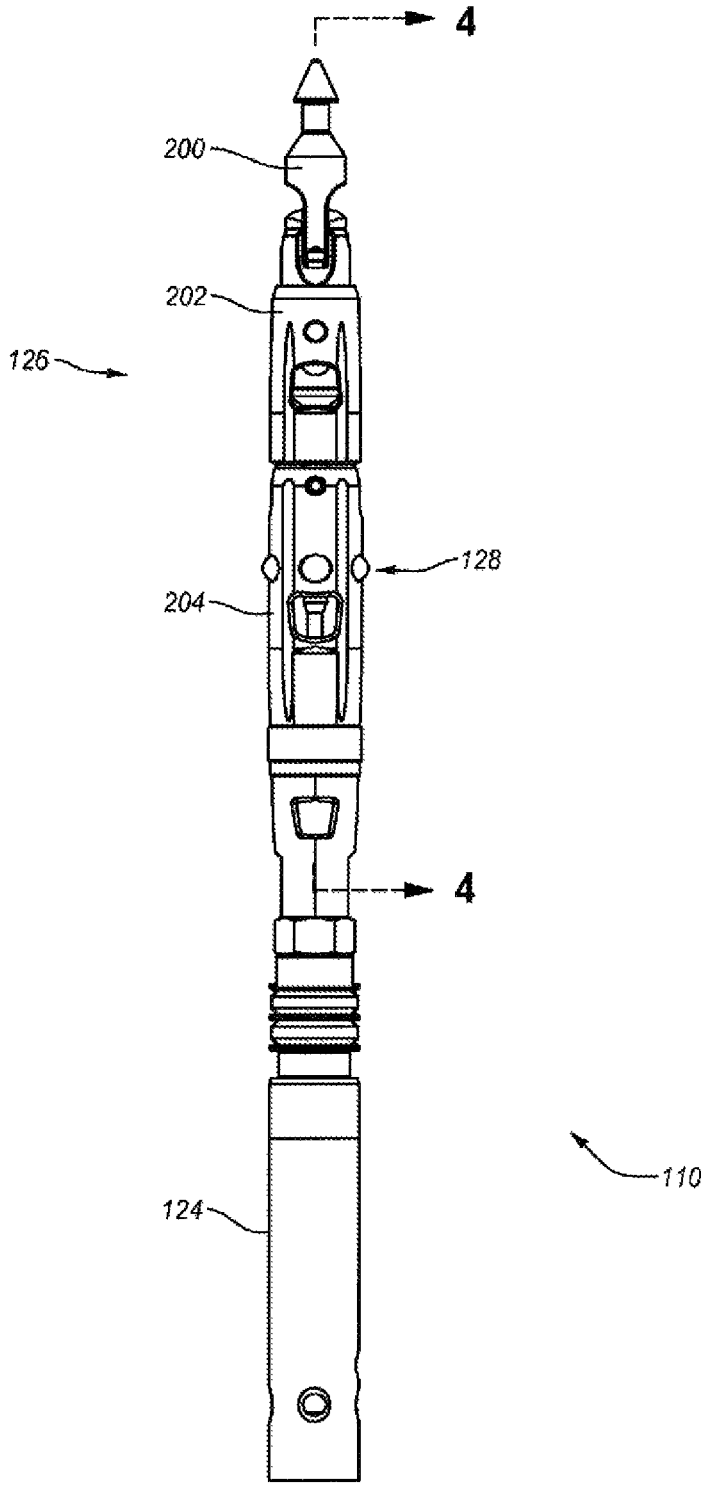
FIG. 2 illustrates an enlarged view of the core barrel assembly of FIG. 1, further illustrating a head assembly and a core barrel.

FIG. 2 illustrates the core barrel assembly 110 in greater detail. As previously mentioned, the core barrel assembly 110 can include a head assembly 126 and a core barrel 124. The head assembly 126 can include a spear head assembly 200 adapted to couple with an overshot, which in turn can be attached to a wireline. Furthermore, the head assembly 126 can include a first member 202, and a sleeve 204 that can house the driven latch mechanism 128.

Figure 3:
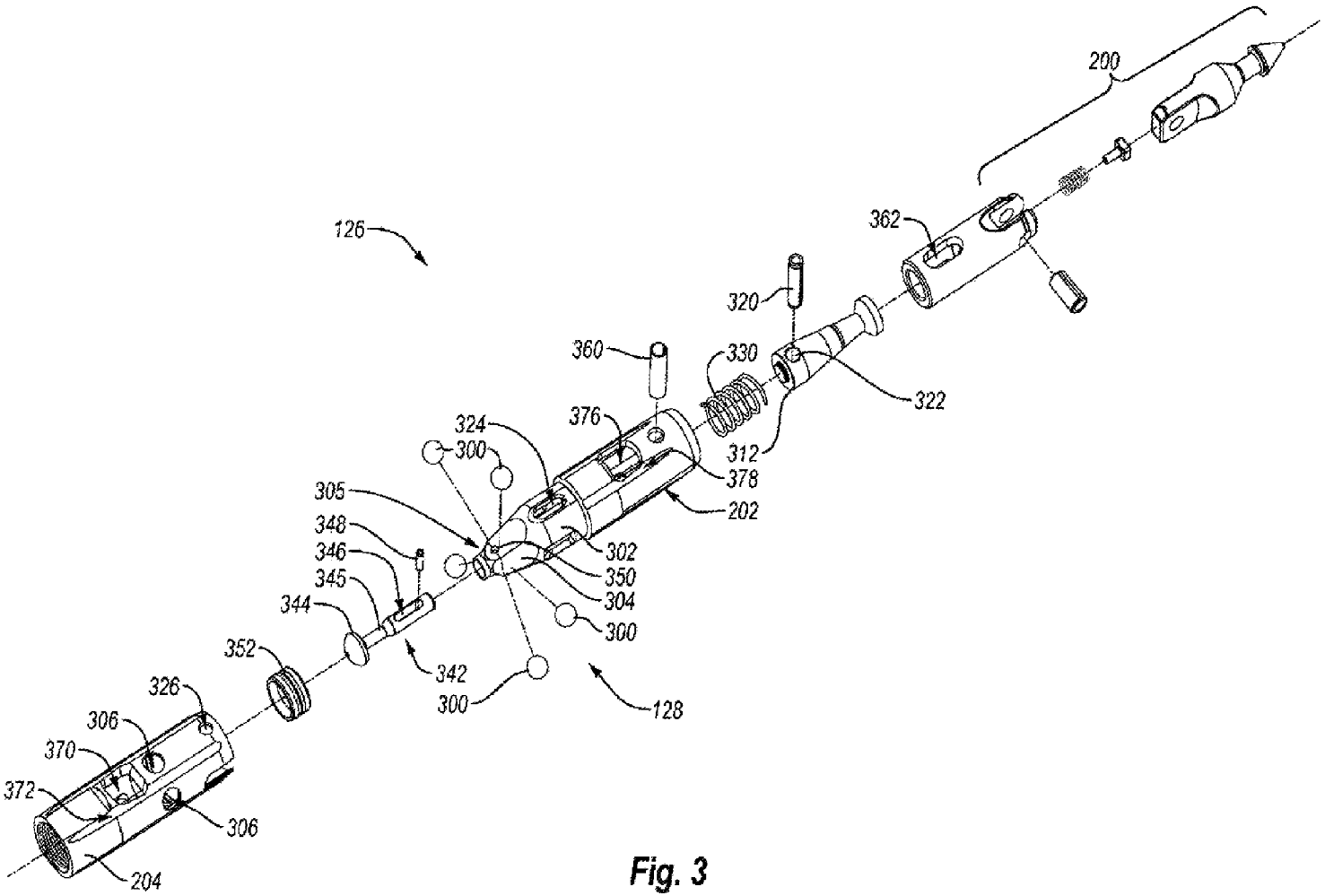
FIG. 3 illustrates an exploded view of the head assembly of FIG. 2.
Figure 4:
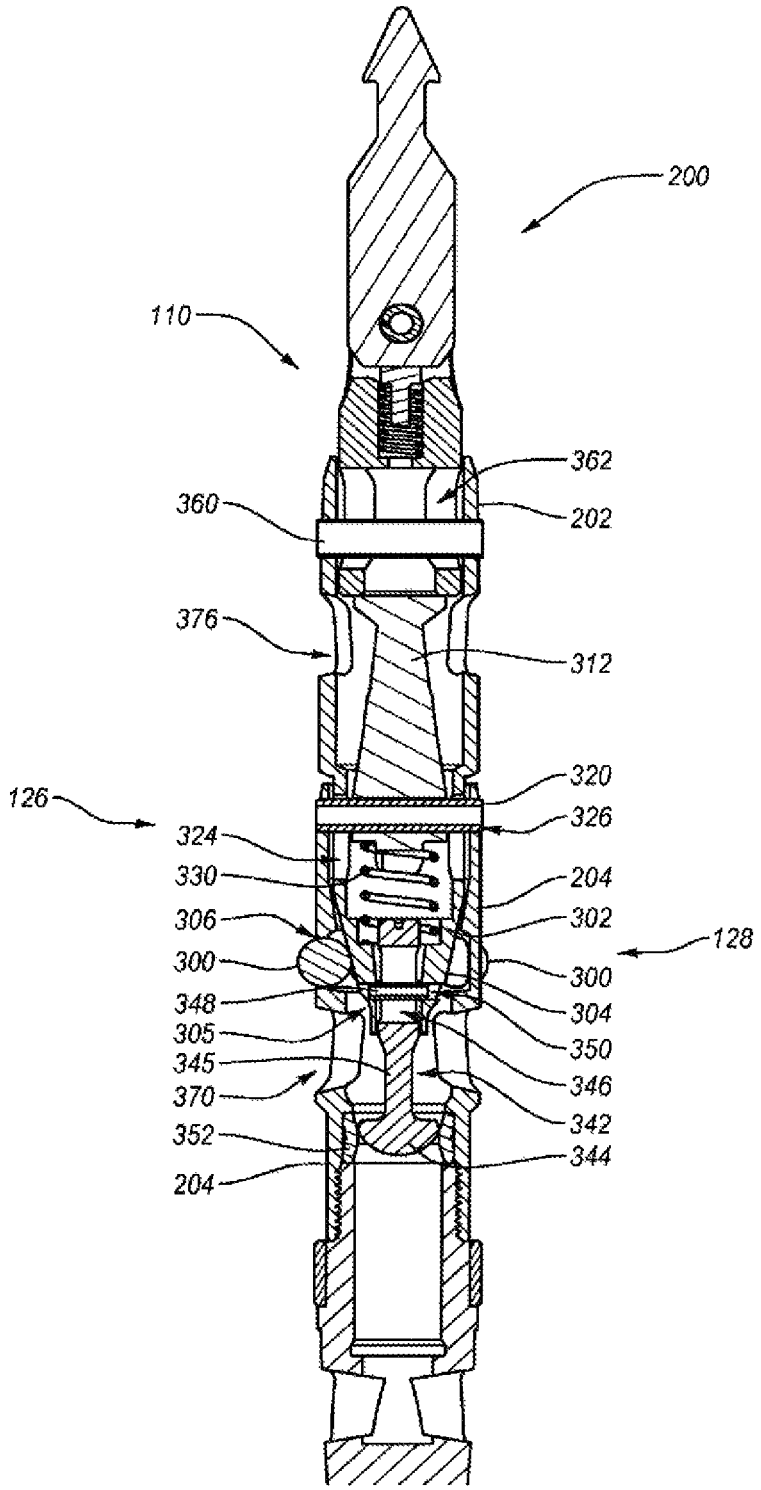
FIG. 4 illustrates a cross-sectional view of the core barrel assembly of FIG. 2 taken along the line 4-4 of FIG. 2.

FIGS. 3 and 4 and the corresponding text, illustrate or describe a number of components, details, and features of the core barrel assembly 110 shown in FIGS. 1 and 2. In particular, FIG. 3 illustrates an exploded view of the head assembly 126. While FIG. 4 illustrates a side, cross-sectional view of the core barrel assembly 110 taken along the line 4-4 of FIG. 2. FIG. 4 illustrates the driven latch mechanism 128 in a fully deployed state. As shown by FIGS. 3 and 4, the driven latch mechanism 128 can include a plurality of wedge members 300. In one or more implementations, the wedge members 300 can comprise a spherical shape or be roller balls, as shown in FIGS. 3 and 4. The wedge members 300 may be made of steel, or other iron alloys, titanium and titanium alloys, compounds using aramid fibers, lubrication impregnated nylons or plastics, combinations thereof, or other suitable materials.

The wedge members 300 can be positioned on or against a driving member 302. More particularly, the wedge members 300 can be positioned on generally planar or flat driving surfaces 304. As explained in greater detail below, the generally planar configuration of the driving surfaces 304 can allow the wedge members 300 to be wedged between the driving member 302 and the inner diameter of a drill string to rotationally lock the core barrel assembly 110 to the drill string.

Figure 5:
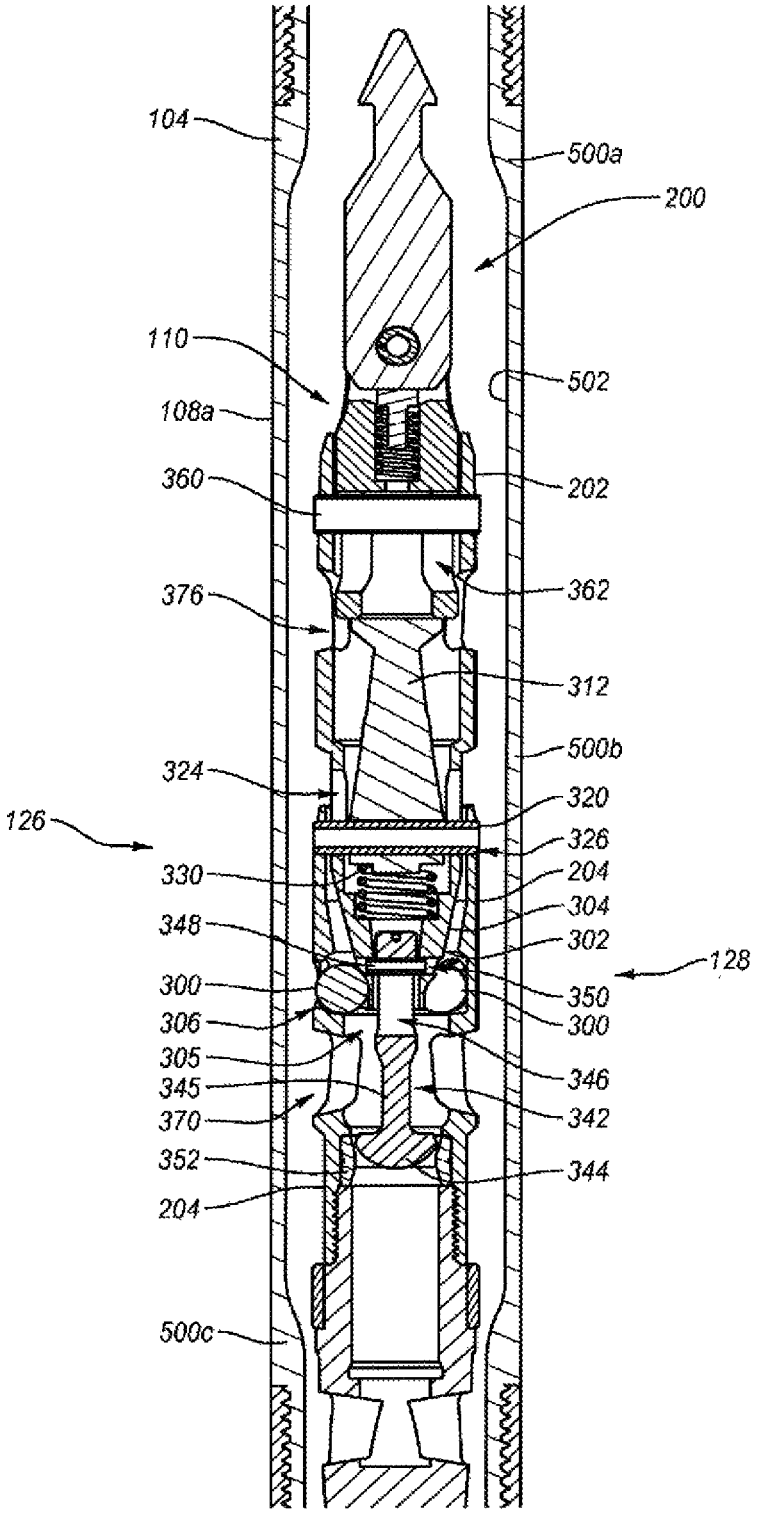
FIG. 5 illustrates a cross-sectional view of the core barrel assembly of FIG. 2 similar to FIG. 4, albeit with the driven latch mechanism locked in a retracted position for tripping the core barrel assembly into or from a drill string.
Figure 6:
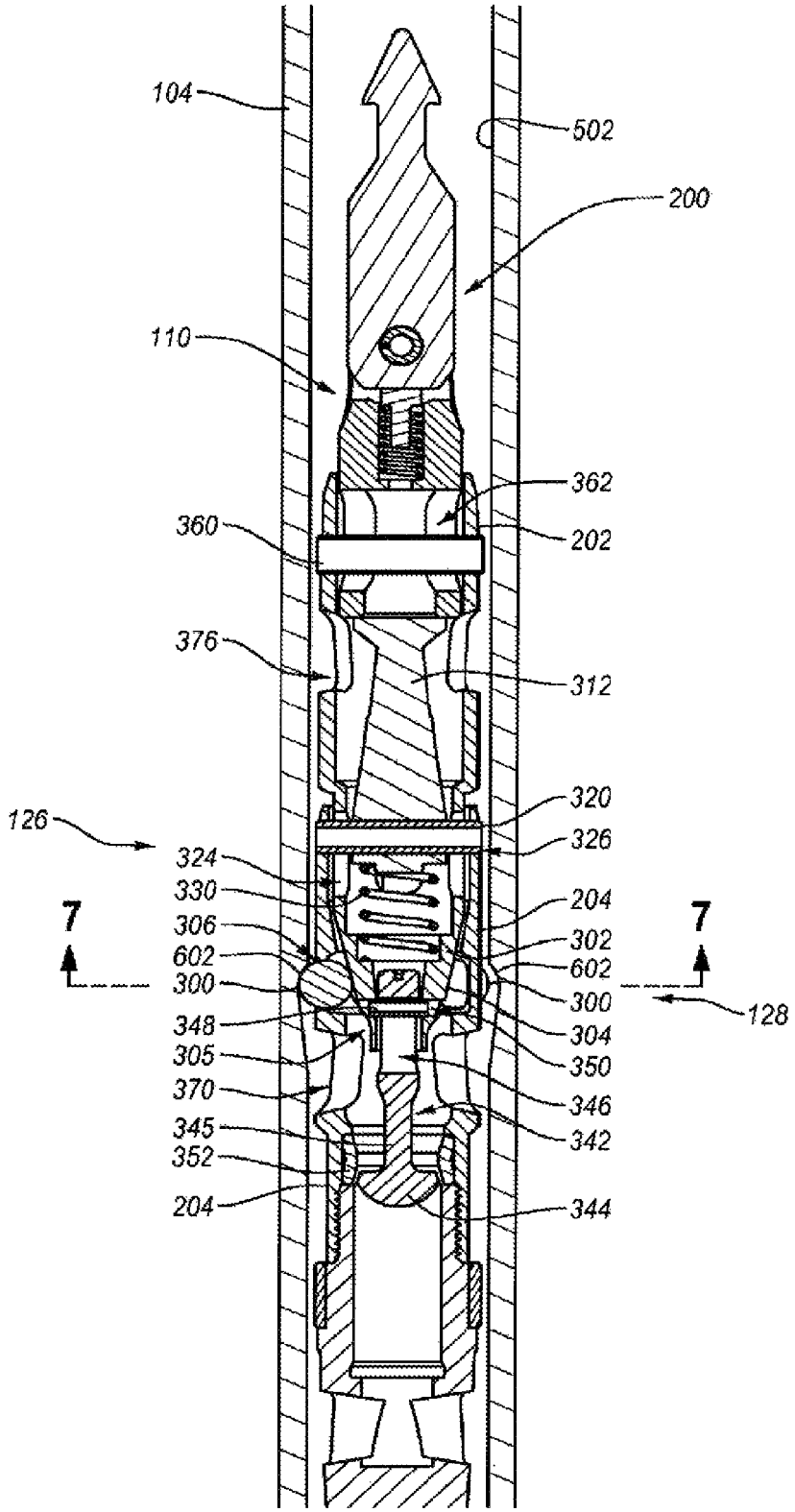
FIG. 6 illustrates a cross-sectional view of the core barrel assembly similar to FIG. 4, albeit with the driven latch mechanism latched to the drill string.

FIGS. 3 and 4 further illustrate that the wedge members 300 can extend through latch openings 306 extending through the generally hollow sleeve 204. The latch openings 306 can help hold or maintain the wedge members 300 in contact with the driving surfaces 304, which in turn can ensure that axial movement of the driving member 302 relative to the sleeve 204 results in radial displacement of the wedge members 300. As explained in greater detail below, as the driving member 302 moves axially toward or farther into the sleeve 204, the driving surfaces 304 can force the wedge members 300 radially outward of the sleeve 204 to a deployed or latched position (FIG. 6). Along similar lines, as the driving member 302 moves axially away from, or out of the sleeve 204, the wedge members 300 can radially retract at least partially into the sleeve 204 into a released position (FIG. 5).

As alluded to earlier, in at least one implementation, the driving member 302 can include one or more grooves for locking the wedge members 300 in position axially along the driving member 302. For example, the driving member 302 can include a retracted groove 305. As explained in greater detail below, the retracted groove 305 can receive and hold the wedge members 300 in a radially retracted position during tripping of the core barrel assembly 110 in or out of a drill string 104.

As used herein the term "groove" refers to any feature or geometry capable of receiving and/or maintaining one or more wedge members 300 in a desired positioned along the driving member 302 (and thus a desired radial position, for example, a retracted position or a deployed position). Thus, as shown in FIG. 4, the retracted groove 305 can comprise a lip structure that prevents one or more wedge members 300 from moving axially along the driving member 302 toward the first member 202. In alternative implementations, the refracted groove 305 can comprise a double lip structure that prevents one or more wedge members 300 from moving axially along the driving member 302 toward or away from the first member 202. In yet further implementations, the retracted groove 305 can comprise a circular shaped depression corresponding in size and shape to a wedge member 300. In still further implementations, the retracted groove 305 can comprise a protrusion instead of a recess. One will thus appreciate that the retracted groove 305 (and the deployment groove 802 described herein below) can comprise a feature having any geometry or shape that allows for maintaining one or more wedge members 300 in a desired positioned along the driving member 302.

In one or more implementations, the driving member 302, and more particularly the planar driving surfaces 304 can have a taper, as shown in FIGS. 3 and 4. The taper can allow the driving member 302 to force the wedge balls 300 radially outward as the driving member 302 moves axially closer to, or within, the sleeve 204. Also, the taper of the driving member 302 can allow the wedge members 300 to radially retract at least partially into the sleeve 204 when the driving member 302 moves axially away from the sleeve 204. One will appreciate that the driving member 302 (and driving surfaces 304) need not be tapered. For example, in alternative implementations, the driving member 302 can include a first portion have a smaller diameter, a transition portion, and a second portion with a larger diameter. In other words, the driving member 302 can include a step between a smaller diameter and a larger diameter instead of a taper along its length. The smaller diameter portion of the driving member 302 of such implementations can allow the wedge balls 300 to retract at least partially into the sleeve 204, and the larger diameter of the driving member 302 can force the wedge balls 300 radially outward in order to lock or latch to the drill string 104.

In at least one implementation, the refracted groove 305 can be positioned on the smaller end of the taper of the driving member 302. This can ensure that when the wedge members 300 are secured within the retracted groove 305, the wedge members 300 will be at least partially radially refracted within the sleeve 204. In at least one implementation, the wedge members 300 can be fully retracted within the sleeve 204, when received within the refracted groove 305. In any event, the retracted groove 305 can maintain the wedge members 300 sufficiently within the sleeve 204 as to not engage the drill string 104. Maintaining the wedge members 300 thus retracted within the sleeve 204 can reduce contact between the wedge members 300 and the drill string 104, which in turn can reduce friction and thereby allow for rapid tripping of the core barrel assembly 110 in and out of the drill string 104.

As shown by FIGS. 3 and 4, the retracted groove 305 can extend radially into the driving surfaces 304 of the driving member 302. In the implementation illustrated in the figures, the retracted groove 305 comprises a single groove extending circumferentially around the driving member 302. In alternative implementations, however, the retracted groove 305 can comprise a plurality of grooves positioned on the driving member 302. In such implementations, each of the plurality of retracted grooves can receive and lock a single wedge member 300 in a retracted position.

FIGS. 3 and 4 further illustrate that in addition to first member 202 can be generally hollow and can house a landing member 312. One will appreciate that the sleeve 204, first member 202, and landing member 312 can all be coupled together. In particular, as shown by FIGS. 3 and 4, in at least one implementation a first pin 320 can extend through a mounting channel 322 in the landing member 312. The first pin 320 can then extend through mounting slots 324 of the first member 202 (and more particularly the driving member 302). From the mounting slots 324, the first pin 320 can extend into mounting holes 326 in the sleeve 204. Thus, the landing member 312 and the sleeve 204 can be axially fixed relative to each other. On the other hand, the mounting slots 324 can allow the landing member 312 and the sleeve 204 to move axially relative to the first member 202 or vice versa. Axial movement between the first member 202 and the sleeve 204 can cause the driving surfaces 304 to move the wedge members 300 radially outward and inward.

In alternative implementations, the sleeve 204 and the first member 202 can comprise a single component (i.e., a latch body). In other words, the sleeve 204 and the first member 202 can be fixed relative to each other. In such implementations, the driving member 302 can be moveably coupled to the latch body (i.e., sleeve 204 and first member 202).

FIGS. 3 and 4 further illustrate that the head assembly 126 can include a biasing member 330. The biasing member 330 can be positioned between the landing member 312 and the driving member 302. Thus, the biasing member 330 can bias the driving member 302 toward into the sleeve 204. Thus, in one or more implementations, the biasing member 330 can bias the driving member 302 against the wedge members 300, thereby biasing the wedge members 300 radially outward. The biasing member 330 can comprise a mechanical (e.g., spring), magnetic, or other mechanism configured to bias the driving member 302 toward or into the sleeve 204. For example, FIGS. 3 and 4 illustrate that the biasing member 330 can comprise a coil spring.

Still further, FIGS. 3 and 4 illustrate that the head assembly 126 can include a fluid control member 342. The fluid control member 342 can include a piston 344 and a shaft 345. The shaft 345 can include a channel 346 defined therein. A piston pin 348 can extend within the channel 346 and be coupled to pin holes 350 within the first member 202 (and particularly the driving member 302). The channel 346 can thus allow the piston 344 to move axially relative to the driving member 302. In particular, as explained in greater detail below, the piston 344 can move axially relative to the first member 202 in and out of engagement with a seal or bushing 352 forming a valve. The interaction of the fluid control member 342 will be discussed in more detail hereinafter.

In one or more alternative implementations, the fluid control member 342 can be rigidly attached to the driving member 302. In such implementations, the piston pin 348 can extend into a pin hole rather than a channel 346, which prevents the fluid control member 342 from moving axially relative to the driving member 302.

In conjunction with the fluid control member 342, the core barrel assembly 110 can include various additional features to aid allowing the core barrel assembly 110 to travel within the drill string 104. In particular, the sleeve 204 can include one or more fluid ports 370 extending through the sleeve 204. Additionally, the sleeve 204 can include one or more axial pathways 372 extending at least partially along the length thereof. Similarly, first member 202 can include one or more fluid ports 376 extending through the first member 202. Furthermore, the first member 202 can include one or more axial pathways 378 extending at least partially along the length thereof.

One will appreciate in light of the disclosure herein that the fluid ports 370, 376 can allow fluid to flow from the outside diameter of the head assembly 126 into the center or bore of the head assembly 126. The axial pathways 372, 378 on the other hand can allow fluid to flow axially along the head assembly 126 between the outer diameter of the head assembly 126 and the inner diameter of a drill string 104. In addition to the fluid ports and axial pathways, the core barrel assembly 110 can include a central bore that can allow fluid to flow internally through the core barrel assembly 110.

As previously mentioned, the head assembly 126 can include a spearhead assembly 200. The spear head assembly 200 can be coupled to the first member 202 via a spearhead pin 360. The spearhead pin 360 can extend within a mounting channel 362 in the spearhead assembly 200, thereby allowing the spearhead assembly 200 to move axially relative to the first member 202.

Referring now to FIGS. 5-9 operation of the core barrel assembly 110, driven latch mechanism 128, and retracted groove 305 will now be described in greater detail. As previously mentioned, in one or more implementations of the present invention the core barrel assembly 110 can be lowered into a drill string 104. For example, FIG. 5 illustrates the core barrel assembly 110 as it is tripped into or down a drill string 104.

In particular, prior to placing the core barrel assembly 110 into the drill string 104, an operator can lock the wedge members 300 into the retracted groove 305. For example, the operator can press the pull the driving member 302 out of or away from the sleeve 204. By so doing the biasing member 330 can be compressed, and the wedge members 300 can be received into the retracted groove 305, as shown in FIG. 5.

Engagement between the retracted groove 305 and the wedge members 300 can cause the wedge members 300 to be seated in the retracted groove 305. Seating the wedge members 300 in the retracted groove 305 can result in a retention force between the wedge members 300, the retracted groove 305, and the walls of the latch openings 306 in the sleeve 204. The retention force can be sufficient to overcome the biasing force the biasing member 330 exerts on the first member 202 and the driving member 302, thereby maintaining or locking the wedge members 300 radially within the sleeve 204. As a result, the latch mechanism 128 can remain in a retracted state as the core barrel assembly 110 is tripped down the drill string 104. Maintaining the wedge members 300 retracted within the sleeve 204 can reduce contact between the wedge members 300 and the drill string 104, which in turn can reduce friction, and thereby allow for rapid tripping of the core barrel assembly 110 in and out of the drill string 104.

Additionally, one or more of the drill rods 108 of the drill string 104 may include variable wall thicknesses. In one or more implementations, at least one section of a drill rod 108 in the drill string 104 may have a varying cross-sectional wall thickness. For example, the inner diameter of the drill rod 108 can vary along the length thereof, while the outer diameter of the drill rod 108 remains constant. For example, FIG. 5 illustrates that the drill rod 108*a* can include a first end 500*a*, a middle portion 500*b*, and a second end 500*c*. As shown the middle section 500*b* of the drill rod 108*a* can be thinner than the ends 500*a*, 500*c* of the drill rod 108*a*. One will appreciate in light of the disclosure herein, that the thinner middle section 500*b* can create additional clearance between the core barrel assembly 110 and the inner surface 502 of the drill string 104.

The cross-sectional wall thickness of the drill rod 108*a* may vary any suitable amount. For instance, the cross-sectional wall thickness of the drill rod 108*a* may be varied to the extent that the drill rod maintains sufficient structural integrity and remains compatible with standard drill rods, wirelines, and/or drilling tools. By way of example, the drill rod 108*a* can have a cross-sectional wall thickness that varies between about 15% to about 30% from its thickest to its thinnest section. Nevertheless, the cross-sectional wall thickness of the drill rods may vary to a greater or lesser extent in one or more additional implementations.

The varying wall thickness may allow the core barrel assembly 110 to move through the drill string 104 with less resistance. Often, the drilling fluid and/or ground fluid within the drill string 104 may cause fluid drag and hydraulic resistance to the movement of the core barrel assembly 110. The varying inner diameter of drill string 104 may allow the drilling fluid or other materials (e.g., drilling gases, drilling muds, debris, air, etc.) contained in the drill string 104 to flow past the core barrel assembly 110 in greater volume, and therefore flow more quickly. For example, fluid may flow past core barrel assembly 110 as the core barrel assembly 110 passes through the wider sections of the drill string 104 during tripping. In combination with the latch mechanism 128 retained in a retracted position inside of the retracted groove 305, the contact between the latch mechanism 128 the inner surface 502 of the drill string 104 can be minimized, and thereby, significantly reduce drag between the drill string 104 and the core barrel assembly 110.

Figure 17:
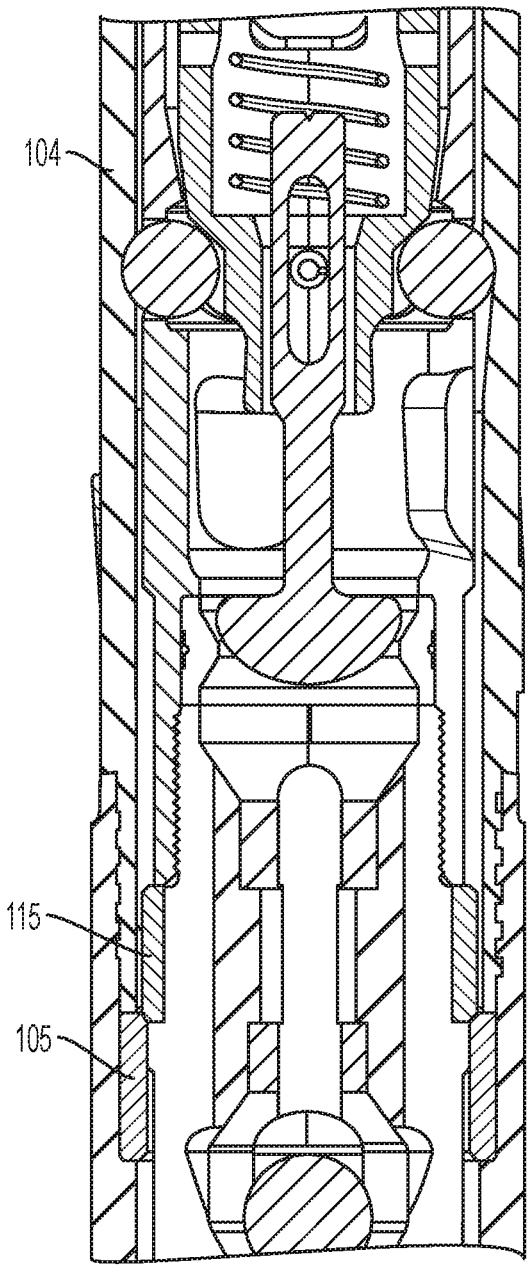
FIG. 17 is a partial cross-sectional view of an exemplary drilling head assembly positioned against a landing ring as disclosed herein.

Referring now to FIG. 6 and FIG. 17, once the in-hole assembly or core barrel assembly 110 has reached its desired location within the drill string 104; the distal end of the core barrel assembly 110 can pass through the last drill rod and land on a landing ring 105 that sits on the top of the outer tube 112. At this point the latching mechanism 128 can deploy thereby locking the core barrel assembly 110 axially and rotationally to the drill string 104. For example, in some exemplary aspects, the impact of the core barrel assembly 110 contacting the landing ring 105, in combination with the biasing forces created by the biasing member 330, can overcome the retention force maintaining the wedge members 300 within the retracted groove 305. Optionally, in other exemplary aspects, upon reaching the drilling position, it is contemplated that the drill string can be rotated to cause the core barrel head assembly to spin, thereby generating a centrifugal and/or radial force that acts on the wedge members 300 to overcome the frictional retention forces created by the biasing member 330 to cause deployment of the wedge members.

Once the core barrel assembly 110 has landed on the landing seat, core barrel assembly 110 can be submerged in a fluid. During drilling operations, this fluid can be pressurized. The pressurization of the fluid, along with the sealing contact between the distal end of the core barrel assembly 110, can cause the pressurized fluid to enter the ports 370, 376. Pressurized fluid entering the ports 370, 376 can produce a distally acting fluid force on the piston 344 of the fluid control member 342. The piston 344 in turn can exert a distally acting force that drives the fluid control member 342 distally until the proximal end of the channel 346 engages the pin 348. As a result, once the proximal end of the channel 346 engages the pin 348, the distally acting fluid force exerted on the fluid control member 342 is transferred through the pin 348 to the driving member 302, thereby pulling the driving member 302 toward or into the sleeve 204. This force created by the fluid control member 342 can work together with the biasing force created by the biasing member 330 to overcome the retention force maintaining the wedge members 300 within the retracted groove 305. In other exemplary aspects, and with reference to FIG. 17, upon reaching the drilling position, it is contemplated that the drill string can be rotated through the frictional mating of a landing shoulder 115 of the head assembly and the landing ring 105 of the outer tube assembly. In these aspects, it is contemplated that rotation of the drill string in this manner can cause the core barrel head assembly to spin, thereby generating a centrifugal and/or radial force that acts on the wedge members 300 to overcome the frictional retention forces created by the biasing member 330 to overcome the retention force acting on the latch mechanism and cause deployment of the wedge members.

In any event, once the retention force has been overcome, the biasing member 330 can force the driving member 302 distally toward (and in some implementations at least partially into) the sleeve 204. Movement of the driving member 302 toward or into the sleeve 204 can urge the driving surfaces 304 into increasing engagement with the wedge members 300. In other words, axial translation of the driving member 302 toward the sleeve 204 can cause the driving surfaces 304 to force the wedge members 300 radially outward as they move along the tapered driving surfaces 304. This movement can cause the driving surfaces 304 drive the wedge members 300 radially outward (through the latch openings 306) and into engagement with the inner surface 502 of the drill string 104. In particular, the wedge members 300 can be driven into engagement with an annular groove 602 formed in the inner surface 502 of the drill string 104 as shown by FIG. 6.

With the wedge members 300 deployed in the annular groove 602, the driven latch mechanism 128 can lock the core barrel assembly 110 axially in the drilling position. In other words, the wedge members 300 and the annular groove 602 can prevent axial movement of the core barrel assembly 110 relative to the outer tube 112 or drill string 104. In particular, the driven latch mechanism 128 can withstand the drilling loads as a core sample enters the core barrel 124. Additionally, the drive latch mechanism 128 can maintain a deployed or latched condition despite vibration and inertial loading of mating head assembly components, due to drilling operations or abnormal drill string movement.

One will appreciate that when in the drilling position, the biasing member 330 can force the driving member 302 distally, thereby forcing the wedge members 300 radially outward into the deployed position. Thus, the driven latch mechanism 128 can help ensure that the wedge members 300 do not disengage or retract unintentionally such that the core barrel inner tube assembly rises from the drilling position in a down-angled hole, preventing drilling.

In addition to the foregoing, FIG. 6 further illustrates that when in the drilling position, the piston 344 can pass distally beyond the bushing 352. This can allow fluid to flow within the core barrel assembly 110. Thus, the fluid control member 342 can allow drilling fluid to reach the drill bit 106 to provide flushing and cooling as desired or needed during a drilling process. One will appreciate in light of the disclosure herein that a pressure spike can be created and then released as the core barrel assembly 110 reaches the drilling position and the piston 344 passes beyond the bushing 352. This pressure spike can provide an indication to a drill operator that the core barrel assembly 110 has reached the drilling position, and is latched to the drill string 104.

In addition to axially locking or latching the core barrel assembly 110 in a drilling position, the driven latch mechanism 128 can rotationally lock the core barrel assembly 110 relative to the drill string 104 such that the core barrel assembly 110 rotates in tandem with the drill string 104. As previously mentioned, this can prevent wear between the mating components of the core barrel assembly 110 and the drill string 104 (i.e., the wedge members 300, the inner surface 502 of the drills string 104, the landing shoulder 115 at the distal end of the core barrel, the landing ring 105 at the proximal end of the outer tube 112).

Figure 7:
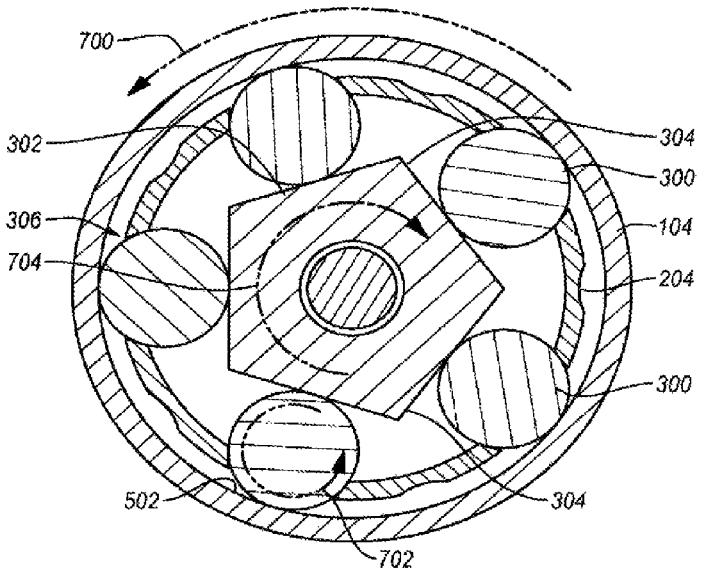
FIG. 7 illustrates a cross-sectional view of the core barrel assembly of FIG. 6 taken along the line 7-7 of FIG. 6.

In particular, referring to FIG. 7 as the drill string 104 rotates (indicated by arrow 700), the core barrel assembly 110 and the driving member 302 can have an inertia (indicated by arrow 704) that without the driven latch mechanism 128 may tend to cause the core barrel assembly 110 not to rotate or rotate a slower rate than the drill string 104. As shown by FIG. 7, however, rotation of the drill string 104 causes the wedge members 300 to wedge in between the driving surfaces 304 of the driving member 302 and the inner surface 502 of the drill string 104 as the rotation of the drill string 104 tries to rotate the wedge members 300 relative to the driving member 302 (indicated by arrow 702). The wedging or pinching of the wedge members 300 in between the driving surfaces 304 and the inner surface 502 of the drill string 104 can rotationally lock the driving member 302 (and thus the core barrel assembly 110) relative to the drill string 104. Thus, the driven latch mechanism 128 can ensure that the core barrel assembly 110 rotates together with the drill string 104.

One will appreciate in light of the disclosure herein that configuration of the driving surfaces 304 and the inner surface 502 of the drill string 104 can create a circumferential taper as shown by FIG. 7. In other words, the distance between the inner surface 502 of the drill string 104 and the driving member 302 can vary circumferentially. This circumferential taper causes the wedge members 300 to wedge in between or become pinched between the drill string 104 and the driving member 302, thereby rotationally locking the core barrel assembly 110 to the drill string 104.

As shown by FIG. 7, in at least one implementation, the circumferential taper between the drill string 104 and the driving surfaces 104 can be created by the planar configuration of the driving surfaces 304. In alternative implementations, the driving surfaces 304 may not have a planar surface. For example, the driving surfaces 304 can have a concave, convex, rounded, v-shape, or other configuration as desired. In any event, one will appreciate that the configuration of the driving surfaces 304 can create a circumferential taper between the driving member 302 and the inner surface 502 of the drill string 104. In yet further implementations, the driving member 302 can have a generally circular cross-section, and the inner surface 502 of the drill string 104 can include a configuration to create a circumferential taper between the inner surface 502 of the drill string 104 and the driving surfaces 304 or driving member 302.

Figure 8:
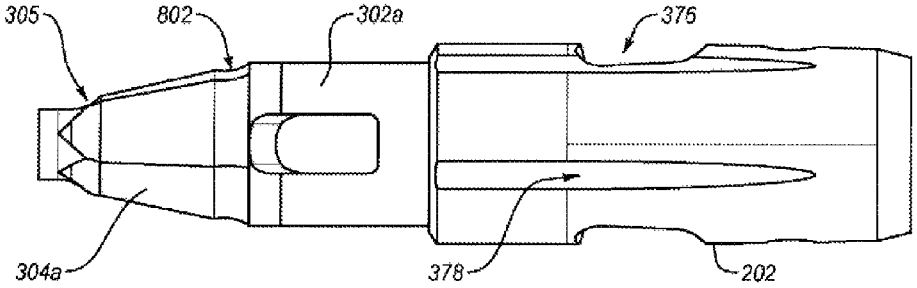
FIG. 8 illustrates a view of a core barrel component including both a retracted groove and a deployed groove.

In addition to a retention groove 305, in one or more implementations the driven latch mechanism 128 can also include a deployment groove. For example, FIG. 8 illustrates a driving member 302*a* including both a retention groove 305 and a deployment groove 802. The deployment groove 802 can extend radially into the driving surfaces 304*a* of the driving member 302*a*. In the implementation illustrated in the figures, the deployment groove 802 comprises a single groove extending circumferentially around the driving member 302*a*. In alternative implementations, however, the deployment groove 802 can comprise a plurality of grooves positioned on the driving member 304*a*. Each of the plurality of deployment grooves can receive and lock a single wedge member 300 in a deployed position.

In any case, in at least one implementation the deployment groove 802 can be positioned on the larger end of the taper of the driving member 302*a*. This can ensure that when the wedge members 300 are secured within the deployment groove 802, the wedge members 300 will be at least partially radially extended outside of the sleeve 204. The deployment groove 802 can maintain the wedge members 300 in the deployed position so as to be able to engage the annular groove 602 of the drill string 104. In particular, engagement between the wedge members 300 and the deployment groove 802 can result in a retention that locks or otherwise helps maintain the driven latch mechanism 128 in a deployed state.

In other words, the deployment groove 802 can lock the wedge members 300 in position along the driving member 302, thereby forcing the wedge members 300 radially outward into the deployed position. Thus, the driven latch mechanism 128 (and the deployment groove 802) can help ensure that the wedge members 300 do not disengage or retract unintentionally such that the core barrel inner tube assembly rises from the drilling position in a down-angled hole, preventing drilling.

Figure 9:
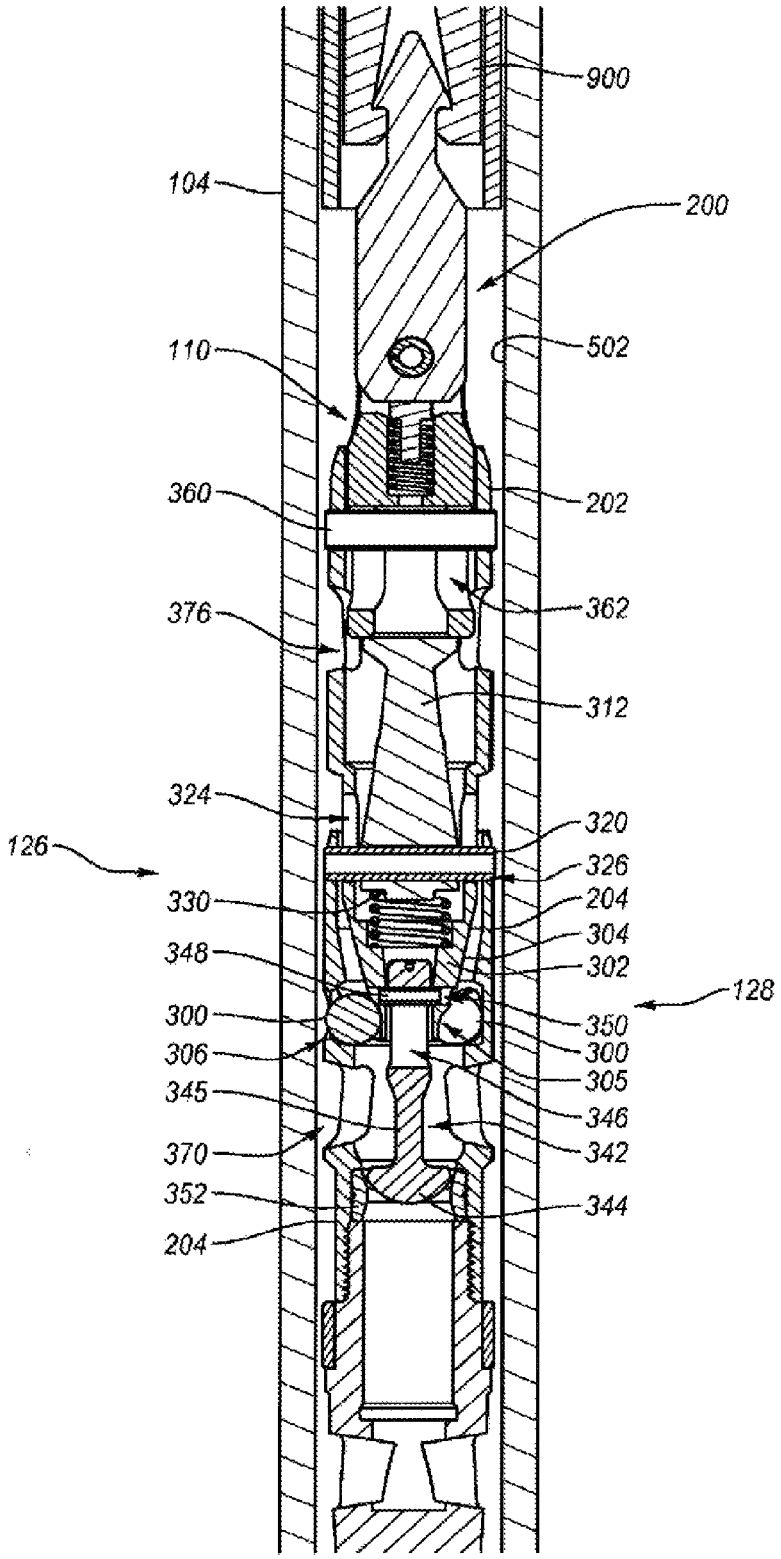
FIG. 9 illustrates a cross-sectional view of the core barrel assembly similar to FIG. 4, albeit with the driven latch mechanism in a released position allowing for retrieval of the core barrel assembly from the drill string.

At some point is may be desirable to retrieve the core barrel assembly 110, such as when a core sample has been captured. Referring to FIG. 9, in order to retrieve the core barrel assembly 110, a wireline can be used to lower an overshot assembly 900 into engagement with the spearhead assembly 200. The wireline can then be used to pull the overshot 900 and spearhead assembly 200 proximally. This in turn can act to draw the first member 202 proximately away from the sleeve 204.

Proximal movement of the first member 202 can cause the driving member 302 to move relative to the sleeve 204 and the wedge members 300. Proximal movement of the driving member 302 relative to the wedge members 300 can cause the wedge members 300 to be pulled from the deployment groove 802. Further movement of the driving member 302 relative to the wedge members 300 can cause the wedge members 300 to radially retract as they move along the tapered driving member 302. Once the first member 202 has been pulled proximately sufficiently, the wedge members 300 can move into the retracted groove 305, thereby locking them in radially within the sleeve 204. At this point, the distal end of the mounting slots 324 can engage the pin 320, thereby pulling the sleeve 204 proximately.

Implementations of the present invention can also include methods of drilling to obtain a core sample using a core drilling tools with retractably lockable driven latch mechanisms. The following describes at least one implementation of a method of obtaining a core sample with reference to the components and diagrams of FIGS. 1 through 9. Of course, as a preliminary matter, one of ordinary skill in the art will recognize that the methods explained in detail herein can be modified using one or more components of the present invention. For example, various acts of the method described can be omitted or expanded, and the order of the various acts of the method described can be altered as desired.

Thus, according to one implementation of the present invention, the method can involve manipulating a core barrel assembly 110 to position a plurality of wedge members 300 into at least one retracted groove 305 on driving member 302.

For example, the method can include moving the driving member 302 relative to a sleeve 204 thereby causing the wedge members 300 to be received within a retracted groove 305. In at least one implementation, this may be done by pulling a first member 202 away from a sleeve 204. The at least one retracted groove 305 can hold the plurality of wedge members 300 in position along the driving member 302, and thus, radially within the sleeve 204.

The method can also involve inserting said core barrel assembly 110 within a drill string 104. For example, a user can lower the core barrel assembly 110 into the drill string 104. The method can then involve sending the core barrel assembly 110 along the drill string 104 to a drilling position. In at least one implementation, the core barrel assembly 110 can move along or down the drill string 104 to the drilling position under the force of gravity.

Upon reaching the drilling position, the plurality of wedge members 300 can automatically move out of the at least one retracted groove 305 into a deployed position in which the plurality of wedge members 300 extend at least partially radially outward of the sleeve 204. For example, a biasing force created by the biasing member 330 can overcome the retention force maintaining the wedge members 300 within the retracted groove 305.

Optionally, in some implementations, the biasing force can work in combination with an impact force created by the impact of the core barrel assembly 110 contacting the landing ring 105 and/or a force generated by fluid acting on the fluid control member 342 to overcome the retention force. The biasing member 330 can then force driving member 302 to move axially relative to sleeve 204. This movement can force the wedge member 300 radially outward of the sleeve 204 until they engage the annular groove 602 within the drill string 104; thereby, locking the core barrel assembly 110 axially to the drill string 104. In some implementations, movement of the driving member 302 relative to sleeve 204 can force the wedge members 300 into the deployment groove 802, which can lock the wedge members 300 in the extended or deployed position.

Similarly, in some optional aspects, it is contemplated that the frictional retention forces created by the biasing member can be overcome with a centrifugal and/or radial force created by spinning the drill string, which in turn causes the core barrel assembly to spin through the frictional engagement between the landing shoulder 115 of the core barrel assembly and the landing ring 105 of the outer tube. In these aspects, it is contemplated that the centrifugal and/or radial force can overcome the retention force acting on the wedge members, thereby permitting deployment of wedge members as further disclosed herein.

As further disclosed herein, and with reference to FIG. 17, the frictional engagement between the landing ring 105 and the landing shoulder 115 can be sufficient to permit rotation of the head assembly with the drill string and thereby generates the centrifugal force required to fully deploy the wedge members into a wedging position to "drive" the core barrel head assembly with the drill rods. It is contemplated that the disclosed systems and methods for latch deployment can require less initial friction than traditional designs because there is no drag from the latches until they deploy. It is further contemplated that if there is no initial friction with the landing ring 105, then conventional fluid-pressure deployment or impact/inertia deployment can be employed.

The method can then involve rotating the drill string 104, thereby causing the plurality of wedge members 300 to wedge between an inner surface 502 of said drill string 104 and the driving member 302, thereby rotationally locking the core barrel assembly 110 relative to the drill string 104. Still further, the method can involve advancing the drill string 104 into a formation 102 thereby causing a portion of the formation 102 to enter the core barrel assembly 110.

The Latch Body

Described herein with reference to FIGS. 10-16B is a latch body 1010 for use in a drilling head assembly 1000. In exemplary aspects, the drilling head assembly 1000 can have a fluid control subassembly 1060, a check valve element 1040, and/or a hollow spindle 1050. Although the drilling head assembly 1000 can comprise any suitable component, in exemplary configurations, the drilling head assembly can comprise a drill string, an inner core barrel assembly comprising an inner core barrel, an outer core barrel assembly comprising an outer core barrel, and a retrieval tool that is connected to a cable. As described herein, the latch body 1010 can comprise the inner and outer core barrel assemblies.

The drill string can include one or more sections of tubular drill rod that are connected together to create an elongated, tubular drill string. The drill string can have any suitable characteristic known in the art. For example, the drill rod can have any suitable length, depending on the drilling application. The drill rod sections can also have any suitable cross-sectional wall thickness. It is contemplated that at least one section of the drill rod in the drill string can have a varying cross-sectional wall thickness.

The drill string can be oriented at any angle, including angles ranging from about 30 degrees to about 90 degrees from a horizontal surface, whether for an up-hole or a downhole drilling process. Indeed, when the drilling head assembly 1000 is used with a drilling fluid in a downhole drilling process, it is contemplated that a downward angle can help retain some of the drilling fluid at the bottom of a borehole. Additionally, it is contemplated that the downward angle can permit the use of a retrieval tool and cable to trip the inner core barrel from the drill string.

The inner core barrel can have any characteristic or component that allows it to connect a downhole object (e.g., a sample tube) with a retrieval tool such that the downhole object can be tripped in or out of the drill string. For example, the inner core barrel can comprise a retrieval point. The retrieval point of the inner core barrel can have any characteristic that allows it to be selectively attached to any retrieval tool, such as, for example and without limitation, an overshot assembly and/or a wireline hoist. For example, the retrieval point can be shaped like a spear point so as to aid the retrieval tool in correct alignment and coupling with the retrieval point. In another example, when the retrieval tool and the inner core barrel are to be handled outside of the drill hole, it is contemplated that the retrieval point can be pivotally attached to the inner core barrel so as to pivot in one plane with a plurality of detent positions.

In exemplary aspects, the latch body 1010 can be a lower latch body that is configured for operative coupling to an upper latch body of the drilling head assembly 1000. In these aspects, the upper latch body can comprise the fluid control subassembly 1060. It is contemplated that the upper latch body can further comprise a latching mechanism that can retain a core sample tube in a desired position with respect to the outer core barrel while the core sample tube is filled. In order to not hinder the movement of the inner core barrel within the drill string, it is contemplated that the latching mechanism can be configured so that the latches do not drag against the interior surface of the drill string. Accordingly, this non-dragging latching mechanism can be any latching mechanism that allows it to perform this retaining function without dragging against the interior surface of the drill string during tripping. For instance, the latching mechanism can comprise a fluid-driven latching mechanism, a gravity-actuated latching mechanism, a pressure-activated latching mechanism, a contact-actuated mechanism, a magnetic-actuated latching mechanism, and the like. Consequently, in some aspects, the latching mechanism can be actuated by electronic or magnetic sub-systems, by valve works driven by hydraulic differences above and/or below the latching mechanism, or by another suitable actuating mechanism.

The latching mechanism can also comprise any component or characteristic that allows it to perform its intended purposes. For example, the latching mechanism may comprise any number of latch arms, latch rollers, latch balls, multi-component linkages, or any mechanism configured to move the latching mechanism into an engaged position when the inner core barrel is seated in an operative position. It is contemplated that the latching mechanism can comprise a detent mechanism that helps maintain the latching mechanism in an engaged or retracted position. It is further contemplated that such a detent mechanism can help hold the latching mechanism in contact with the interior surface of the drill string during drilling. The detent mechanism can also help the latching mechanism to stay retracted so as to not contact and drag against the interior surface of the drill string during any tripping action.

Figure 15:
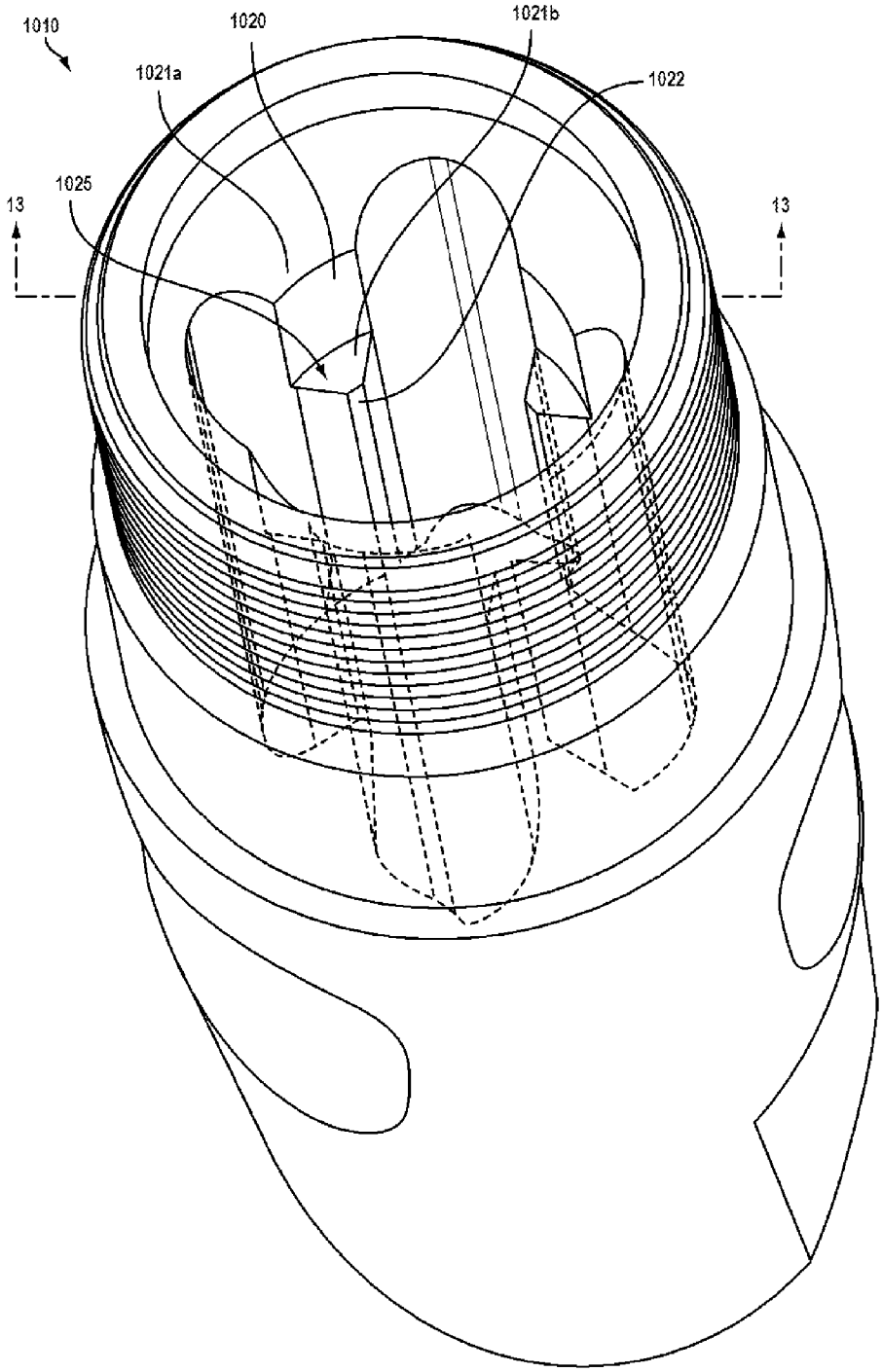
FIG. 15 is a partially transparent perspective view of the latch body of FIG. 13.
Figure 16A:
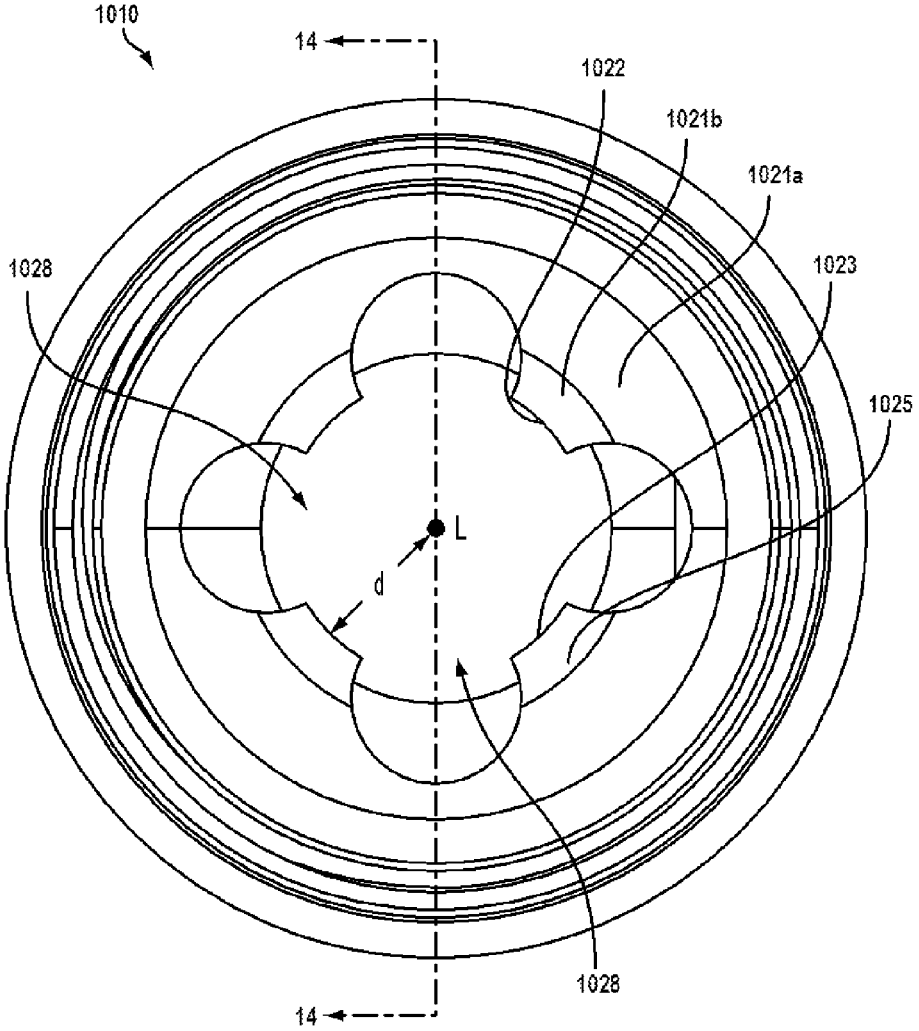
FIG. 16A is a top (proximal) perspective view of the latch body of FIG. 14.
Figure 16B:
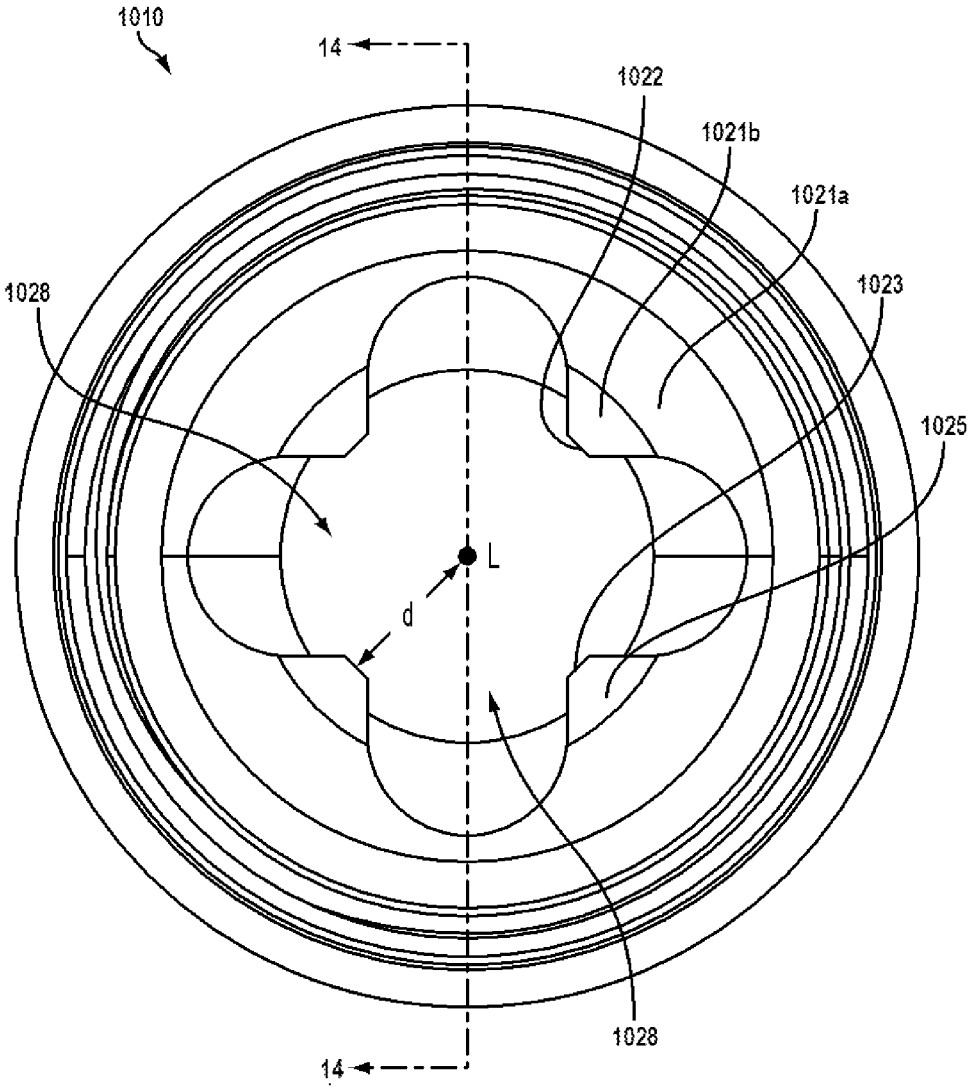
FIG. 16B is a top (proximal) perspective view of the latch body of FIG. 13.

In various aspects, it is contemplated that the latch body 1010 can comprise any component or characteristic suitable for use with an inner core barrel. In one aspect, and with reference to FIGS. 10-14, the latch body 1010 can have a longitudinal axis L, a longitudinal length 1012, a proximal end portion 1014, and a distal end portion 1016. In this aspect, it is contemplated that the proximal end portion 1014 of the latch body 1010 can define a proximal end 1015 of the latch body. It is further contemplated that the distal end portion 1016 of the latch body 1010 can define a distal end 1017 of the latch body. As shown in FIGS. 15-16B, it is contemplated that the longitudinal axis L can be centrally positioned within the latch body 1010 along the longitudinal length 1012 of the latch body. In another aspect, the latch body 1010 can define a central bore 1018 extending along the longitudinal length 1012 of the latch body through the proximal end portion 1014 and the distal end portion 1016. For example, it is contemplated that the central bore 1018 of the latch body 1010 can extend along the entire longitudinal length 1012 of the latch body (between the proximal end 1015 of the latch body and the distal end 1017 of the latch body). It is further contemplated that, when the latch body 1010 corresponds to a lower latch body, the central bore 1018 of the latch body 1010 can be in fluid communication with a complementary bore and/or channel of an upper latch body. In use, it is contemplated that the central bore 1018 of the latch body can increase productivity by allowing fluid to flow directly through the latch body 1010.

In still another aspect, and with reference to FIGS. 10-14, the distal end portion 1016 of the latch body 1010 can comprise a port section 1030. In this aspect, the port section 1030 can define a chamber 1032 in fluid communication with the central bore 1018 of the latch body. The port section 1030 can further define at least one port 1034 in fluid communication with the chamber 1032. In exemplary aspects, it is contemplated that the ports 1034 of the at least one port can be configured to increase passage of heavier drilling fluids, which are advantageous in stabilizing bad ground conditions. It is further contemplated that the ports 1034 of the at least one port can be configured to increase the rate at which drilling fluids are provided to drive cuttings. It is still further contemplated that the port section 1030 of the latch body 1010 can comprise one or more materials that are configured to withstand high static and cyclic loads, such as, for example and without limitation, the vibration and impact loads experienced during drilling operations.

In exemplary aspects, it is contemplated that the chamber 1032 of the port section 1030 can be configured to receive at least a portion of the check valve element 1040 of the drilling head assembly 1000. Thus, in these aspects, the check valve element 1040 is positioned within the latch body 1010, thereby eliminating the need for a separate "check valve body" as is conventionally found in the art. In one exemplary aspect, the check valve element 1040 can be a ball valve. However, it is contemplated that the check valve element 1040 can be any conventional check valve element that provides the fluid control characteristics described herein.

In one aspect, the ports 1034 of the at least one port of the valve body 1010 can be shaped to prevent the check valve element 1040 from exiting the ports. For example, in this aspect, it is contemplated that the ports 1034 of the at least one port can have a diameter that is less than an outer diameter (or other outer dimension) of the check valve element 1040.

Optionally, in various aspects, the chamber 1032 of the port section 1030 can have an inner surface configured to promote movement of the check valve element 1040 between a blocking position in which fluid flow through at least a portion of the chamber is blocked and an open position in which fluid flow through the chamber is permitted. In an exemplary aspect, it is contemplated that a distal portion of the inner surface of the chamber 1032 can have a substantially frusto-conical profile, with the inner surface being inwardly sloped relative to the longitudinal axis L of the latch body 1010 moving from the proximal end 1015 of the latch body to the distal end 1017 of the latch body. Optionally, in this aspect, the distal portion of the inner surface of the chamber 1032 can be inwardly sloped relative to the longitudinal axis L of the latch body 1010 at an angle of less than about 40 degrees. In this aspect, it is further contemplated that the distal portion of the inner surface of the chamber 1032 can be configured to minimize resistance to movement of the check valve element 1040 as gravity pulls the check valve element from an open position into a blocking position. In the blocking position, it is contemplated that the check valve element 1040 can form a fluid seal with a distal opening of the chamber 1032 that is in communication with the central bore 1018 of the latch body 1010. It is contemplated that the open position of the check valve element 1040 can correspond to a position of the check valve element that permits passage of standing fluid through the latch body 1010 to reduce drag during tripping. It is further contemplated that, in any open position, the resistance to passage of fluid around the check valve element can be substantially equivalent. It is still further contemplated that the blocking position of the check valve element 1040 can correspond to a position of the check valve element that prevents passage of drilling supply fluid into a core sample tube, thereby preserving a core sample within the core sample tube.

In exemplary aspects, the check valve element 1040 can permit fluid to flow from a core sample tube to the central bore 1018 while preventing fluid to flow from the central bore to the core sample tube. Accordingly, the check valve element 1040 can be configured to allow fluid to pass into the central bore 1018 and then through the inner core barrel when the inner core barrel is being tripped into the drill string and when the core sample tube is empty. In this manner, it is contemplated that fluid resistance can be lessened, thereby permitting the inner core barrel to be tripped into the drill string faster and more easily. On the other hand, when the inner core barrel is tripped out of the drill string, it is contemplated that the check valve element 1040 can prevent fluid from pressing down on or damaging a core sample contained in core sample tube. Accordingly, the check valve element 1040 can prevent the sample from being dislodged or lost. It is further contemplated that, when the check valve element 1040 prevents fluid from passing through the latch body 1010 and into the core sample tube (in the blocking position), the fluid can be forced to flow around the outside of the core sample tube and the latch body 1010. It is still further contemplated that, when the check valve element 40 is in the blocking position, it can be configured to prevent and/or minimize washing or erosive damage to the core sample.

Figure 10:
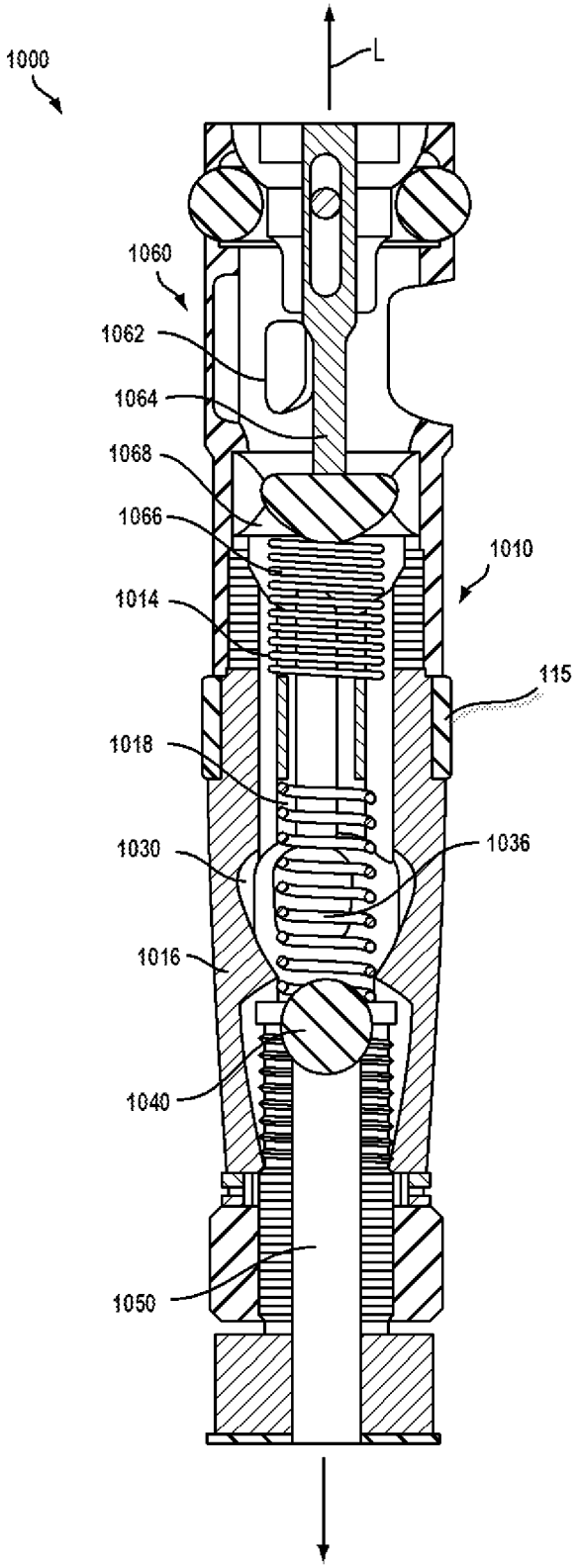
FIGS. 10-12 are partial cross-sectional views of exemplary drilling head assemblies as described herein. Some elements of the exemplary drilling head assemblies are shown in cross-section, while the distal end 1016 of the latch body 1010 of the exemplary drilling head assemblies is shown in partial broken-away perspective. The hatching shown within

Optionally, in additional aspects, and as shown in FIG. 10, the latch body 1010 can further comprise a spring 1036 at least partially received within the chamber 1032 of the port section 1030. In these aspects, the spring 1036 can be configured to bias the check valve element 1040 in the blocking position. It is contemplated that during downhole drilling, the force of gravity can ensure proper biasing of the check valve element 1040; in contrast, during uphole drilling, when the force of gravity is applied in the opposite direction, the spring 1036 can be used to properly bias the check valve element. In one exemplary aspect, a first portion of the spring 1036 can be received within the chamber 1032, and a second portion of the spring can be received within the central bore 1018 of the latch body 1010 (in between the port section 1030 and the proximal end portion 1014 of the latch body). In a further aspect, the spring 1036 can be configured to lift the weight of the check valve element 1040. In this aspect, it is contemplated that the spring 1036 can comprise light, widely spaced wire to thereby limit resistance to fluid flow.

Figure 11:
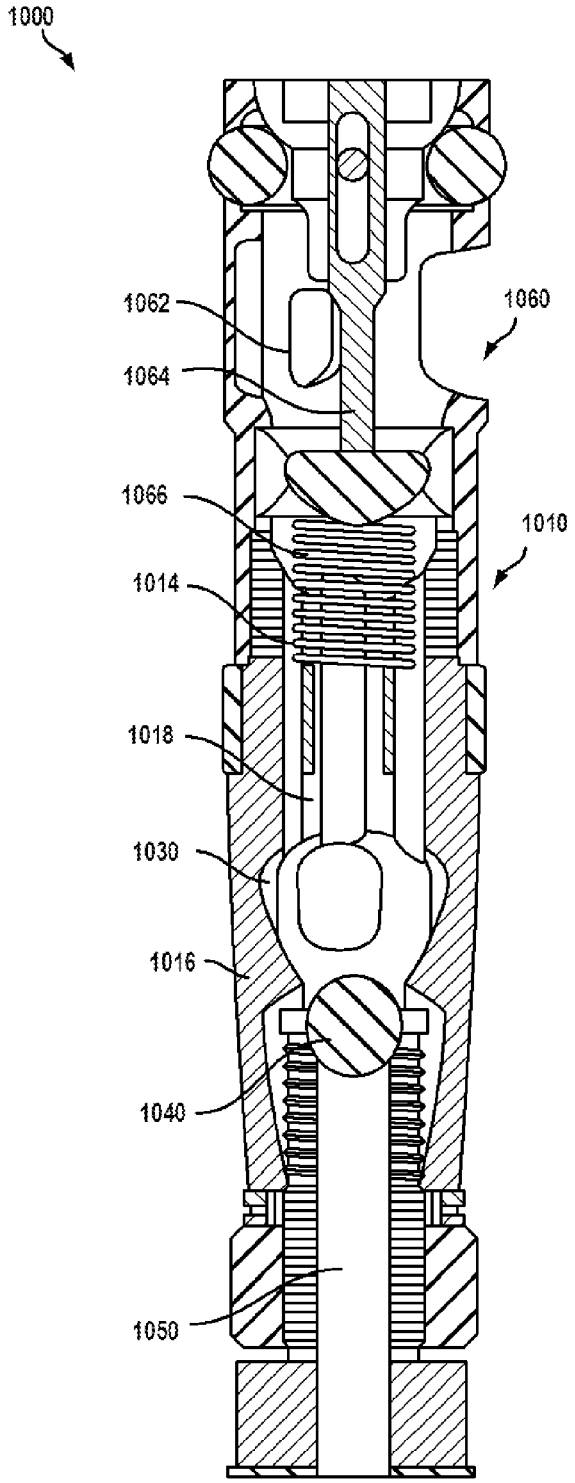
Figure 12:
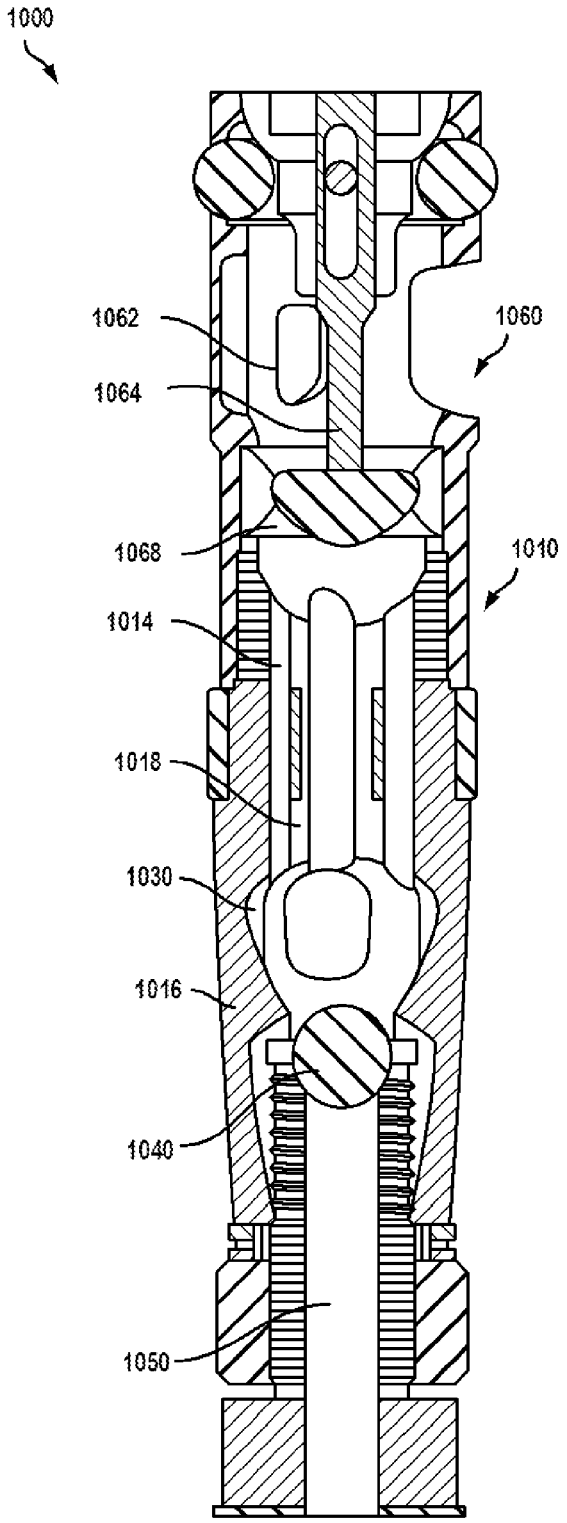

In another exemplary aspect, and with reference to FIGS. 10-12, the fluid control subassembly 1060 can comprise a valve chamber 1062 and a valve member 1064. In this aspect, the valve chamber 1062 can be positioned in fluid communication with the central bore 1018 of the latch body 1010. It is contemplated that the valve chamber 1062 can share a common longitudinal axis L with the latch body 1010. It is further contemplated that the proximal end portion 1014 of the latch body 1010 can be configured to support the fluid control subassembly 1060 in an operative position. For example, it is contemplated that the valve chamber 1062 can be positioned in abutting relation to the proximal end 1015 of the latch body 1010. It is still further contemplated that at least a portion of the valve member 1064 can be positioned within the valve chamber 1062 and configured for movement relative to the common longitudinal axis L. In exemplary aspects, the valve member 1064 can be an elongate piston (as shown in FIGS. 10-12). However, it is contemplated that the valve member 1064 can be any known fluid control valve element, including, for example and without limitation, a ball valve.

Optionally, in an additional aspect, the fluid control subassembly 1060 can comprise a spring 1066 that is positioned within the valve chamber 1062 such that the spring abuts a portion of the proximal end portion 1014 of the latch body 1010 and is biased against the valve member 1064. In a further optional aspect, the fluid control subassembly 1060 can comprise a bushing 1068 mounted within the valve chamber 1062 and axially surrounding at least a portion of the spring 1066. In this aspect, it is contemplated that the bushing 1068 can be configured to restrict fluid flow and create pressure change signals (e.g., higher pressure signals) that are delivered to a drill operator as the valve member 1064 moves relative to longitudinal axis L. It is further contemplated that the valve member 1064 can optionally be configured for positioning within the bushing 1068 in an interference fit, thereby permitting the bushing 1068 to operate as a pressure indicator. It is contemplated that, when the valve member 1064 is configured for positioning within the busing 1068 in an interference fit, the bushing can comprise nylon or other like materials. However, it is further contemplated that, when the valve member 1064 is not configured for positioning within the bushing 1068 in an interference (i.e., when there is some amount of clearance), the bushing can comprise steel or other like materials.

In exemplary aspects, it is contemplated that the spring 1066 can provide adequate resistance to the valve member 1064 to ensure that at least some fluid is delivered to a drill bit of the drilling head assembly 1000. For example, the spring 1066 can resist the creation of an elevated fluid pressure by the valve member 1064, thereby ensuring fluid communication between a drill rig and the drill bit. In exemplary aspects, the spring 1066 can have sufficient stiffness to generate large resistance loads that exert significant fluid flow pressure (ranging from about 500 to about 1,500 psi) and resist fluctuation, thereby providing a smooth response and reliable fluid control. In these aspects, the spring 1066 can comprise a die spring or other spring having heavy rectangular section wire as are conventionally known in the art. It is contemplated that, without the spring 1066 to resist the valve member 1064, some fluid can be lost to a ground formation. In exemplary aspects, the bushing 1068 can be positioned in abutting relation to the proximal end 1015 of the latch body 1010. In these aspects, it is contemplated that the proximal end 1015 of the latch body 1010 can function as a landing shoulder for the bushing 1068. Thus, it is contemplated that the latch body 1010 can provide both (1) a seat for spring 1066 and/or bushing 1068 of the fluid control subassembly 1060 and (2) a housing for check valve element 1040.

In various exemplary aspects, it is contemplated that the fluid control subassembly 1060 can be configured to control the amount of drilling fluid that passes through the inner core barrel during tripping and/or drilling. In these aspects, it is contemplated that the fluid control subassembly 1060 can have any characteristic or component consistent with these functions. In another aspect, it is contemplated that the valve member 1064 can be coupled to an outer core barrel by any known connector, such as a pin. In this aspect, it is further contemplated that the pin can travel within an axial slot such that the valve member 1064 can move axially with respect to both the inner core barrel and the outer core barrel. In exemplary aspects, when the fluid control subassembly comprises bushing 68, the valve member 1064 can axially move between an open position and a closed position through interaction with the bushing 1068. Optionally, the fluid control subassembly 1060 can be configured for engagement with a fluid supply pump, with the fluid supply pump being configured to deliver fluid and pressure to generate fluid drag across the valve member 1064 such that the valve member engages and/or moves past the bushing 1068.

In exemplary aspects, the inner core barrel can comprise one or more fluid ports that are in fluid communication with the exterior of the inner core barrel. In use, when the valve member 1062 is in an open position, it is contemplated that fluid can flow from the (lower) latch body 1010, through the fluid control subassembly 1060 (and past and/or around the valve member), and through the fluid ports of the inner core barrel. With the valve member in the open position, the latching mechanism can be positioned in a retracted position and configured for insertion into the drill string. Optionally, in this open position, it is contemplated that fluid can flow from the (lower) latch body 1010 to the upper latch body, but fluid pressure can force the valve member 1062 toward the bushing

1068, thereby causing the valve member to press against the bushing and prevent fluid flow.

In an additional aspect, and with reference to FIGS. 13-16B, the latch body 1010 can comprise a plurality of male protrusions 1020 extending inwardly toward and spaced from the longitudinal axis L of the latch body. In this aspect, each protrusion of the plurality of male protrusions can have a leading end 1022 spaced a selected distance d from the longitudinal axis L of the latch body 1010. Optionally, in another aspect, the leading end 1022 of each protrusion 1020 of the plurality of male protrusions can comprise an edge surface 1023. Optionally, as shown in FIG. 16B, the edge surface 1023 can be substantially flat. However, it is contemplated that the edge surface 1023 of each leading end 1022 can have any shape that preserves the functionality of the protrusions as described herein. For example, as shown in FIG. 16A, it is contemplated that the edge surface 1023 of the leading end 1022 can be an arcuate surface having a curvature such that the selected distance d between the leading end and the longitudinal axis L remains substantially consistent moving radially along the edge surface 1023. It is further contemplated that the leading end 1022 of at least one protrusion 1020 of the plurality of male protrusions can optionally have a different geometric and/or angular profile from a leading end of another protrusion of the plurality of male protrusions.

In yet another optional aspect, and with reference to FIGS. 10-11 and 13-16B, each protrusion 1020 of the plurality of male protrusions of the latch body 1010 can define a proximal engagement surface 1025 oriented substantially perpendicularly to the common longitudinal axis L of the latch body and the valve member 1062 of the fluid control subassembly 1060. In this aspect, the proximal engagement surface 1025 of each male protrusion 1020 of the plurality of male protrusions can be configured to abut the spring 1066 of the fluid control subassembly 1060. Thus, it is contemplated that the selected distance d between each protrusion 1020 and the longitudinal axis L can be selected depending upon the outer diameter of the spring 1066 and/or valve member 1062. It is further contemplated that the selected distance d can be selectively varied as necessary to withstand drilling loads and vibration, thereby avoiding fatigue failure and other complications. Subject to these limitations, it is also contemplated that maximization of the selected distance d can, in turn, maximize fluid flow through the latch body 1010.

Figure 13:
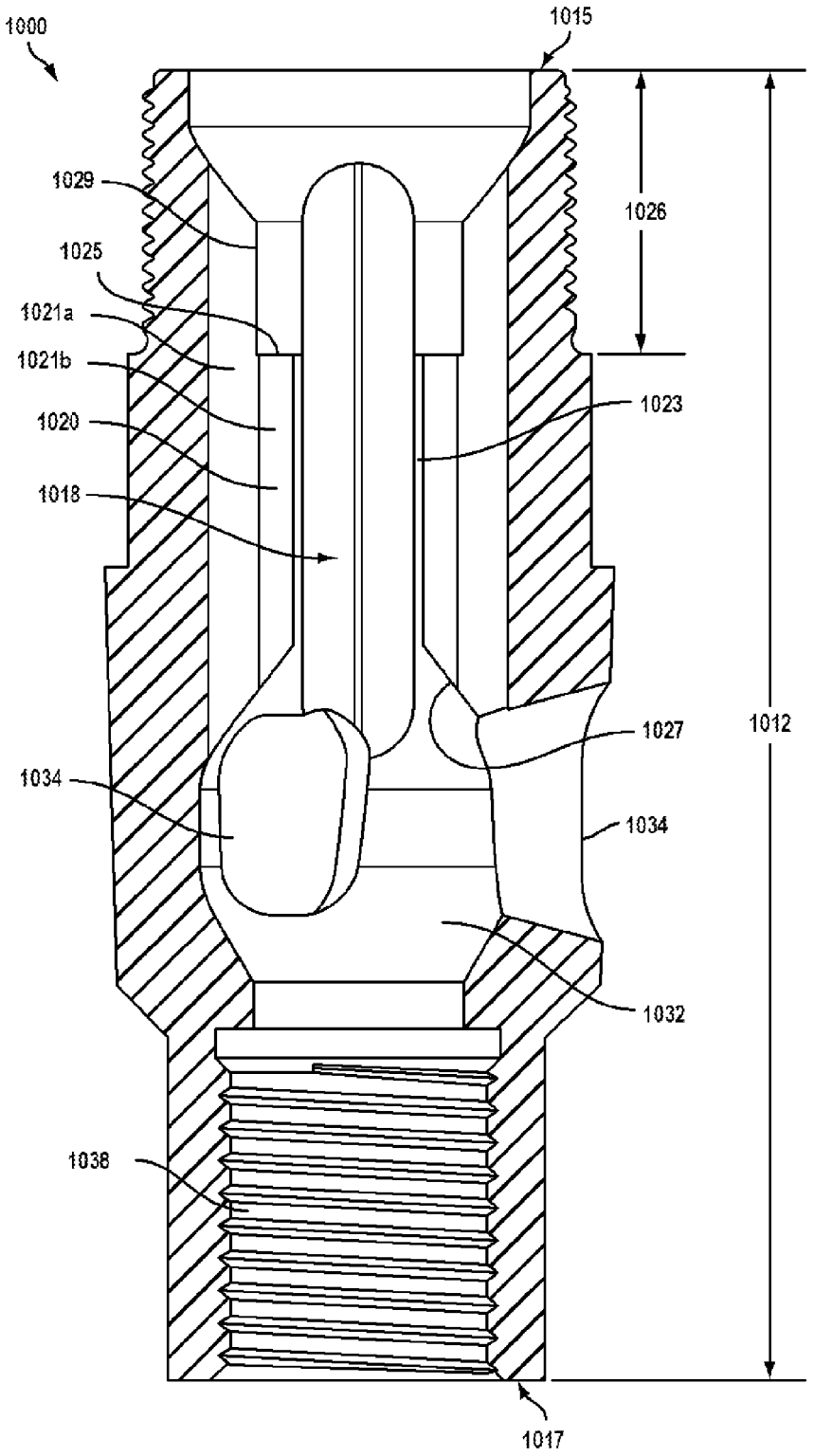
FIG. 13 is a partial cross-sectional view of an exemplary latch body having a plurality of male protrusions, a plurality of channels, and a port section as described herein. The partial cross-sectional view is taken along line 13-13 of FIGS. 15 and 16B.
Figure 14:
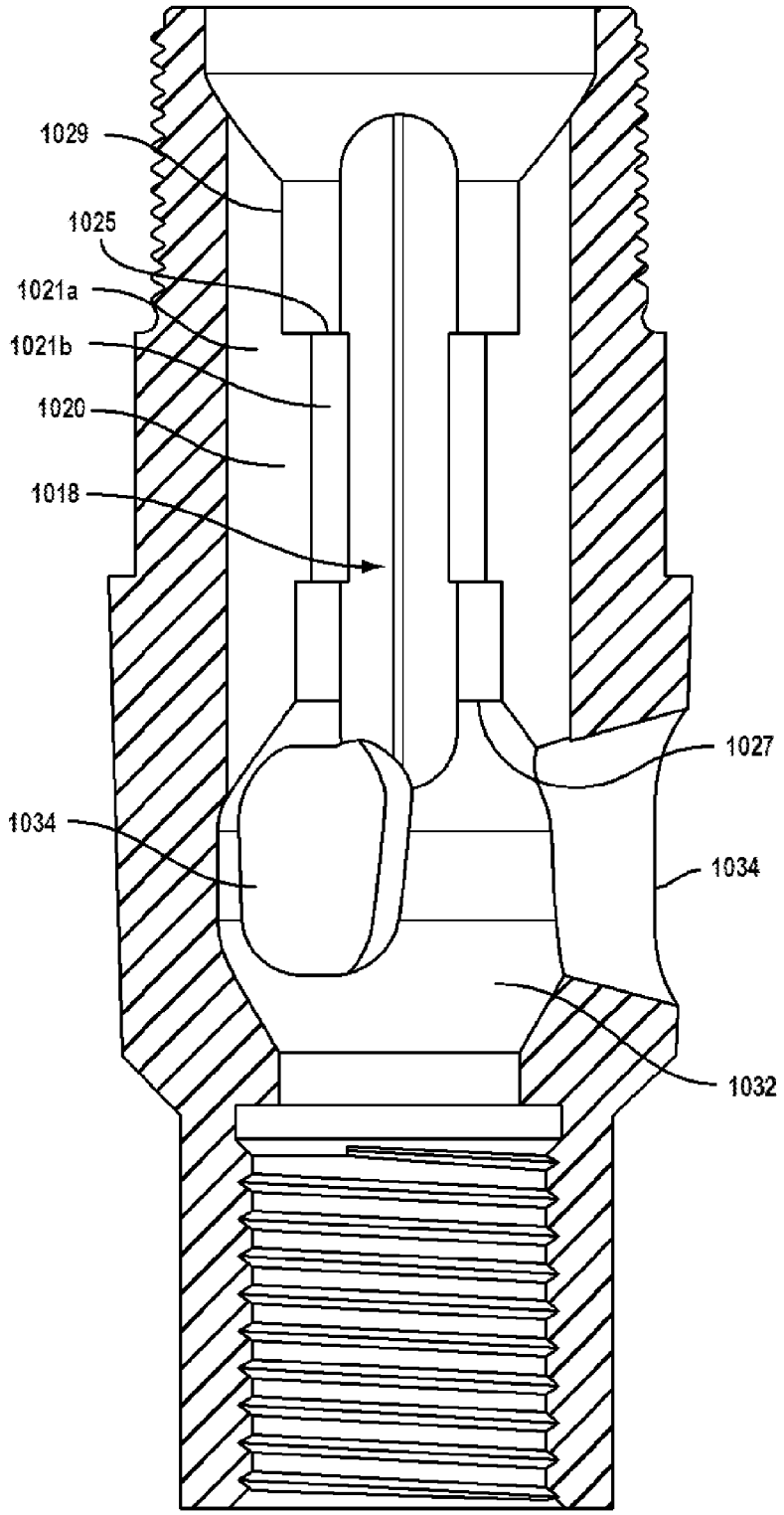
FIG. 14 is a partial cross-sectional view of another exemplary latch body having a plurality of male protrusions, a plurality of channels, and a port section as described herein. The partial cross-sectional view is taken along line 14-14 of FIG. 16A.

As shown in FIGS. 13-14, it is optionally contemplated that the proximal engagement surface 1025 of each male protrusion 1020 of the plurality of male protrusions can be spaced from the proximal end 1015 of the latch body 1010 by a selected distance 1026 along the longitudinal length 1012 of the latch body. It is contemplated that the selected distance 1026 can be selected depending upon the longitudinal length of spring 1066, with the spring being selected to provide sufficient resistance to valve member 1064. In one exemplary aspect, the selected distance 1026 can be less than the longitudinal length of spring 1066 (when the spring is in an unstressed position), thereby permitting compressive preloading of the spring when the spring is positioned in engagement with the proximal engagement surfaces 1025 of the male protrusions 1020 and the valve member 1064. Optionally, in this aspect, pre-loading of the spring can be configured to provide a high initial resistance to the valve member 1064 upon contact. Alternatively, in another aspect, the latch body 1010 can be configured to receive at least a portion of the spring 1066 such that the spring imparts no resistance upon first contact with the valve member 1064, and the bushing 1068 and the valve member can be configured to cooperate with the spring to provide a desired fluid pressure response profile and/or signal. In exemplary aspects, the bushing 1068 can be positioned proximate the proximal end 1015 of the latch body 1010; thus, it is contemplated that selected distance 1026 can substantially correspond to the longitudinal spacing between the bushing 1068 and the proximal engagement surfaces 1025 of the latch body.

Optionally, in an exemplary aspect, the outer surface of the proximal end portion 1014 of the latch body 1010 can have a threaded portion. In this aspect, the threaded portion of the outer surface of the latch body 1010 can extend from the proximal end 1015 of the latch body along a portion of the longitudinal length 1012 of the latch body. Optionally, as shown in FIGS. 13-14, it is contemplated that the distance by which the threaded portion of the outer surface of the latch body 1010 extends along the longitudinal length 1012 of the latch body can substantially correspond to selected distance 1026.

In exemplary optional aspects, each male protrusion 1020 of the plurality of male protrusions can have a base portion 1021*a* and an extension portion 1021*b*. In these aspects, as shown in FIGS. 15-16B, it is contemplated that the extension portion 1021*b* of each male protrusion 1020 can extend inwardly toward longitudinal axis L relative to the base portion 1021*a*. It is further contemplated that the proximal engagement surface 1025 of each male protrusion 1020 can be defined by the extension portion 1021*b*. In additional aspects, as shown in FIGS. 13-14, the base portion 1021*a* of each male protrusion can comprise a proximal portion 1029 that is positioned between the extension portion 1021*b* and the proximal end 1015 of the latch body 1010 relative to the longitudinal axis L of the latch body.

In yet another optional aspect, and with reference to FIGS. 10-14, each protrusion 1020 of the plurality of male protrusions of the latch body 1010 can define (or cooperate with the inner surface of the port section 1030 to define) a distal engagement surface 1027. In one exemplary aspect, the distal engagement can be configured to abut the check valve element 1040 upon movement of the check valve element toward the proximal end portion 1014 of the latch body relative to the common longitudinal axis L of the latch body and the fluid control subassembly 1060. In this aspect, as shown in FIG. 13, it is contemplated that the distal engagement surface 1027 can be inwardly sloped toward the longitudinal axis L of the latch body 1010 moving along the longitudinal length 1012 of the latch body from the distal end 1017 to the proximal end 1015 of the latch body. Thus, it is contemplated that the latch body 1010 can define a seat for both the check valve element 1040 and the fluid control subassembly 1060, including valve member 1064.

In another exemplary aspect, as shown in FIG. 14, the distal engagement surface 1027 can be oriented substantially perpendicularly to the longitudinal axis L of the latch body. In this aspect, the distal engagement surface 1027 of each male protrusion 1020 of the plurality of male protrusions can be configured to abut the spring 1036 of the latch body 1010.

In a further aspect, the latch body 1010 can comprise a plurality of channels 1028 extending radially outwardly from the longitudinal axis L of the latch body. In this aspect, it is contemplated that each channel 1028 of the plurality of channels can span between the leading ends 1022 of adjacent male protrusions 1020. It is further contemplated that the plurality of channels 1028 of the latch body 1010 can be configured to permit fluid flow around the valve member 1064 of the fluid control subassembly 1060 and the check valve element 1040 relative to the common longitudinal axis L. In exemplary aspects, each channel 1028 of the plurality of channels can optionally be substantially U-shaped. However, it is contemplated that each channel 1028 of the plurality of channels can have any shape that preserves the functionality of the channels 1028 as described herein. It is further contemplated that at least one channel 1028 of the plurality of channels can optionally have a different geometric and/or angular profile from another channel of the plurality of channels. In exemplary aspects, the plurality of channels can be formed by a pattern of drilled holes. In other exemplary aspects, it is contemplated that the plurality of channels can be formed by two perpendicular milled paths, such as can be formed using a conventional round milling bit.

In one exemplary aspect, the plurality of channels 1028 can comprise four channels. However, it is contemplated that the plurality of channels 1028 can comprise any number of channels that preserve the fluid flow characteristics of the latch body 1010 as described herein. Thus, for example and without limitation, it is contemplated that the plurality of channels 1028 can comprise three, five, six, seven, eight, nine, ten, eleven, or twelve channels.

In use, it is contemplated that the larger the channels 1028 are, the less resistance will be provided to drilling fluid flow. However, it is also contemplated that the latch body 1010 can comprise sufficient material to maintain drilling loads and support spring loads. Optionally, it is contemplated that the channels 1028 can have a substantially symmetrical profile as measured from a plane bisecting the latch body 1010 through the longitudinal axis L of the latch body. However, in other aspects, it is contemplated that the channels 1028 can have an asymmetrical profile.

In exemplary aspects, the hollow spindle 1050 of the drilling head assembly 1000 can be operatively coupled to the chamber 1032 of the port section 1030 of the latch body 1010. In these aspects, it is contemplated that the hollow spindle 1050 can be positioned in fluid communication with the chamber 1032 of the port section 1030 of the latch body 1010. In one aspect, the hollow spindle 1050 can be configured to support the check valve element 1040 in the blocking position. In this aspect, it is contemplated that this positioning of the check valve element 1040 (supported between the hollow spindle 1050 and housed within the chamber 1032 of the port section 1030 of the latch body 1010) can permit fluid to flow completely through the spindle when the check valve element is in the open position. It is further contemplated that, when the latch body comprises spring 1036, the spring can bias the check valve element 1040 against the hollow spindle 1050 in the blocking position.

Optionally, in another aspect, the distal end portion 1016 of the latch body 1010 can further comprise an engagement section 1038 positioned in fluid communication with the chamber 1032 and configured for engagement with the hollow spindle 1050. In this aspect, the engagement section 1038 can be positioned between the port section 1030 and the distal end 1017 of the latch body 1010 relative to longitudinal axis L (such that the engagement section defines a portion of central bore 1018). It is contemplated that the engagement section 1038 can have a threaded inner surface that is configured for complementary engagement with a threaded outer surface of hollow spindle 1050. However, it is understood that the engagement section 1038 can comprise any known means for mechanical, axially aligned engagement.

In exemplary aspects, it is contemplated that the described drilling head assembly 1000 and/or latch body 1010 can provide means for confirming positioning of the latch body 1010 in a drilling position. In these aspects, the drilling position can correspond to (a) the landing of the latch body 1010 at the bottom and/or end of a drill hole and/or (b) the engagement between the latch body 1010 and a drill string. In one aspect, and with reference to FIG. 17, when the drilling head assembly 1000 and latch body 1010 are used in conjunction with a landing ring 105, it is contemplated that the means for confirming positioning of the latch body 1010 in a drilling position can comprise means for detecting engagement between the latch body and the landing ring and/or between an inner tube assembly and the landing ring. In another aspect, it is contemplated that the means for confirming positioning of the latch body 1010 in the drilling position can comprise means for detecting fluid flow and/or pressure changes within the latch body 1010. In a further aspect, when the head assembly 1000 comprises a plurality of rollers, one or more detent springs, and a plurality of latches as are conventionally known in the art, it is contemplated that the means for confirming positioning of the latch body 1010 in the drilling position can comprise means for rotating the head assembly 1000 such that sufficient centrifugal force is created to drive one or more rollers of the head assembly radially outwardly, overcome the loading of the one or more detent springs, and deploy the plurality of latches into a drilling position. Similarly, when the head assembly 1000 comprises a driven latch mechanism comprising a plurality of wedge members 300 as disclosed herein, it is contemplated that the means for confirming positioning of the latch body 1010 in the drilling position can comprise means for rotating the drill string and, thus, the head assembly 1000, such that sufficient centrifugal force is created to drive one or more wedge members radially outwardly, and deploy the plurality of wedge members into a drilling position, allowing a valve piston to advance through an indicator bushing to generate a fluid pressure signal to the operator. It is contemplated that rotation of the head assembly 1000 in this manner can ensure drilling (latched) position of the latch body 1010 is achieved. In operation, it is further contemplated that, when the latch body 1010 is positioned in the drilling (latched) position, centrifugal force can drive the rollers or wedge members into a locking coupling groove of the head assembly 1000 and allow underlying flats under each roller or wedge member to slightly rotate, thereby wedging the rollers into a locking position and driving the head assembly in rotation with a drill string. As further disclosed herein, the frictional engagement between the landing ring 105 and the landing shoulder 115 can be sufficient to permit rotation of the head assembly with the drill string and thereby generates the centrifugal force required to fully deploy the wedge members into a wedging position to "drive" the core barrel head assembly with the drill rods. It is contemplated that the disclosed systems and methods for latch deployment can require less initial friction than traditional designs because there is no drag from the latches until they deploy.

It is contemplated that, in some variations of the described drilling head assembly 1000, one or more of the various components of the latch body 1010 and/or fluid control subassembly 1060 can be incorporated with a variety of other downhole or uphole tools and/or objects. In exemplary aspects, it is contemplated that the drilling head assembly 1000 can comprise a driven latch mechanism comprising a plurality of wedge members as disclosed herein.

It is further contemplated that the described drilling head assembly 1000 and/or latch body 1010 can comprise one or more of the components and features disclosed in U.S. Pat. Nos. 5,934,393, 6,029,758, 6,089,335, and U.S. Patent Application Publication No. 2010/0012383, each of which is incorporated herein by reference in its entirety.

As alluded to previously, numerous variations and alternative arrangements may be devised by those skilled in the art without departing from the spirit and scope of this description. For example, core barrel assembly in accordance with the present invention can include a conventional latching mechanism (such as spring-driven pivoting latches or mechanical link latches) to provide axial locking, and a driven latch mechanism to provide rotational locking. For instance, this could be done by modifying a head assembly component such as a lower latch body to include roller elements that engage the inner diameter of the landing ring 105 which sits in the outer tube. In such a configuration, the lower latch body can include driving surfaces and a retainer member that allows the roller elements to become wedged between the driving surfaces and the outer tube, thereby rotationally locking the lower latch body to the inner diameter of the landing ring 105. Thus, the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A core barrel head assembly configured to be removably received within a drill string, the drill string having a longitudinal axis, an outer tube, and an inner surface defining an annular groove, the core barrel head assembly comprising:

a sleeve having a plurality of openings extending there through;

a plurality of wedge members positioned at least partially within respective openings of the plurality of openings, the plurality of wedge members being unattached to the core barrel head assembly;

a driving member having an outer surface defining a plurality of driving surfaces spaced circumferentially about the outer surface, the driving member being positioned at least partially within the sleeve, the driving member comprising at least one first groove extending therein, the at least one first groove being configured to receive and maintain the plurality of wedge members in a retracted position within the sleeve, wherein, within the at least one first groove, the plurality of wedge members are retained in the retracted position by a retention force;

a biasing member configured apply a biasing force to bias the driving member against the plurality of wedge members; and a landing portion defining a landing shoulder, the landing shoulder configured for frictional engagement with a landing ring of the outer tube, wherein, during the frictional engagement between the landing shoulder and the landing ring of the outer tube, the core barrel head assembly is configured to rotate with the drill string, and wherein the rotation of the drill string is configured to produce a centrifugal force that overcomes the retention force, thereby causing the wedge members to extend radially outward of the sleeve into the annular groove in the inner surface of the drill string.

2. The core barrel head assembly of claim 1, wherein the at least one first groove of the driving member is configured to maintain the plurality of wedge members in the retracted position such that the plurality of wedge members do not drag along the inner surface of the drill string during tripping of the core barrel head assembly.

3. The core barrel head assembly of claim 2, wherein the plurality of wedge members are adapted to axially lock the core barrel head assembly relative to the drill string by extending radially outward of the sleeve into the annular groove in the inner surface of the drill string.

4. The core barrel head assembly as recited in claim 1, wherein each wedge member of the plurality of wedge members is generally spherical.

5. The core barrel head assembly as recited in claim 1, wherein the driving member varies in diameter along at least a portion of its length.

6. The core barrel head assembly as recited in claim 1, further comprising:

a valve positioned within the sleeve; and a ball piston configured to engage the valve and prevent fluid from passing through the sleeve past the valve.

7. The core barrel head assembly as recited in claim 1, wherein the driving surfaces of the plurality of driving surfaces are planar.

8. The core barrel head assembly as recited in claim 1, further comprising at least one second groove extending into the driving member, the at least one second groove being adapted to receive and maintain the plurality of wedge members in a deployed position wherein the plurality of wedge members extend radially outward of the sleeve.

9. A drilling system for retrieving a core sample, comprising:

a drill string having a longitudinal axis, an inner surface, a landing ring, and a plurality of drill rods, the inner surface of the drill string defining an annular groove;

a core barrel head assembly having a landing portion and a sleeve defining a plurality of openings, the core barrel assembly being adapted to be inserted within the drill string, wherein the landing portion defines a landing shoulder configured for frictional engagement with the landing ring of the drill string, a driven latch mechanism positioned within the core barrel assembly, wherein the driven latch mechanism comprises a driving member, a plurality of wedge members, and a biasing member configured apply a biasing force to bias the driving member against the plurality of wedge members, the plurality of wedge members being positioned on the driving member and unattached to the core barrel assembly, the driving member having an outer surface defining a plurality of driving surfaces spaced circumferentially about the outer surface, the driving member comprising at least one first groove extending therein, the at least one first groove being configured to receive and maintain the plurality of wedge members in a retracted position, wherein, within the at least one first groove, the plurality of wedge members are retained in the retracted position by a retention force;

wherein, during the frictional engagement between the landing shoulder and the landing ring of the outer tube, the core barrel head assembly is configured to rotate with the drill string, and wherein the rotation of the drill string is configured to produce a centrifugal force that overcomes the retention force, thereby causing the wedge members to extend radially outward of the sleeve into the annular groove in the inner surface of the drill string.

10. The drilling system of claim 9, wherein the at least one first groove of the driving member is configured to maintain the plurality of wedge members in the retracted position such that the plurality of wedge members do not drag along the inner surface of the drill string during tripping of the core barrel head assembly.

11. The drilling system of claim 9, wherein the plurality of wedge members are adapted to axially lock the core barrel assembly relative to the drill string by extending radially outward of the sleeve into the annular groove in the inner surface of the drill string.

12. The drilling system of claim 9, wherein the plurality of driving surfaces are configured to wedge the plurality of wedge members between the inner surface of the drill string and the driving member such that the core barrel head assembly is rotationally locked relative to the drill string.

13. The drilling system of claim 9, wherein the driving member further comprises at least one second groove, wherein the at least one second groove is adapted to lock the plurality of wedge members in a deployed position wherein the plurality of wedge members are radially positioned at least partially outside of the core barrel head assembly.

14. The drilling system of claim 9, wherein each wedge member of the plurality of wedge members comprises a generally spherical ball.

15. The drilling system of claim 9, wherein at least one drill rod of the plurality of drill rods has an inner diameter that varies along the length of the at least one drill rod.

16. The drilling system of claim 9, further comprising a spearhead assembly coupled to the core barrel head assembly.

17. A method of drilling using a core barrel assembly comprising a sleeve, a driving member, and a plurality of wedge members, comprising:

manipulating the core barrel assembly to position the plurality of wedge members into at least one retracted groove on the driving member, the driving member having an outer surface defining a plurality of driving surfaces spaced circumferentially about the outer surface, the driving member being positioned at least partially within the sleeve, the plurality of wedge members being unattached to the core barrel assembly, the driving member defining a plurality of driving surfaces, the at least one retracted groove being configured to receive and maintain the plurality of wedge members in a retracted position within the sleeve, wherein, within the at least one retracted groove, the plurality of wedge members are retained in the retracted position by a retention force;

inserting the core barrel assembly within a drill string, the drill string having a longitudinal axis and an inner surface, the inner surface of the drill string defining an annular groove;

moving the core barrel assembly within the drill string to a drilling position, wherein, in the drilling position, a landing shoulder of the core barrel assembly frictionally engages a landing ring of a drill string, wherein during the frictional engagement between the landing shoulder and the landing ring, the core barrel assembly is configured to rotate with the drill string; and rotating the drill string to produce a centrifugal force that overcomes the retention force, thereby causing the wedge members to extend radially outward of the sleeve into the annular groove in the inner surface of the drill string.

18. The method of drilling of claim 17, wherein the driving member is configured to maintain the plurality of wedge members in the retracted position within the at least one retracted groove such that the plurality of wedge members do not drag along an inner surface of the drill string during movement of the core barrel assembly within the drill string, and wherein rotation of the drill string is configured to effect movement of the plurality of wedge members out of the at least one retracted groove into a deployed position in which the plurality of wedge members extend at least partially radially outward of the sleeve, thereby axially locking the core barrel assembly relative to the drill string.

19. The method of drilling of claim 17, further comprising:

lowering an overshot onto a spearhead of the core barrel assembly; and pulling on the overshot to retract the core barrel assembly;

wherein the pulling moves the plurality of wedge members into the at least one retracted groove.

20. The method of drilling of claim 17, wherein the plurality of wedge members are locked within a deployment groove formed in the driving member when in the deployed position.

21. The method of drilling of claim 17, wherein a biasing member forces the driving member to move axially relative to the sleeve upon reaching the drilling position.

22. The method of drilling of claim 17, further comprising advancing the drill string into a formation thereby causing a portion of the formation to enter the core barrel assembly.

* * * * *